US007997560B2

(12) United States Patent
Bergdoll

(10) Patent No.: US 7,997,560 B2
(45) Date of Patent: Aug. 16, 2011

(54) FENCE COVERING SYSTEM

(75) Inventor: James Bergdoll, Setauket, NY (US)

(73) Assignee: Tutunjian & Bitetto, P.C., Melville, NY (US)

( * ) Notice: Subject to any disclaimer, the term of this patent is extended or adjusted under 35 U.S.C. 154(b) by 1193 days.

(21) Appl. No.: 10/835,715

(22) Filed: Apr. 30, 2004

(65) Prior Publication Data

US 2004/0217340 A1 Nov. 4, 2004

Related U.S. Application Data

(60) Provisional application No. 60/466,949, filed on May 2, 2003.

(51) Int. Cl.
*E04H 17/16* (2006.01)

(52) U.S. Cl. ..... 256/24; 256/32; 256/67; 256/1

(58) Field of Classification Search ..... 256/1, 24, 256/32, 33, 25–31; 211/87.01, 88.01; 40/308, 40/604, 617, 607.03
See application file for complete search history.

(56) References Cited

U.S. PATENT DOCUMENTS

| | | | | | |
|---|---|---|---|---|---|
| 3,305,221 | A * | 2/1967 | Kling | 256/21 |
| 4,773,175 | A * | 9/1988 | Larsen | 40/308 |
| 5,301,443 | A * | 4/1994 | Gori | 40/308 |
| 5,402,988 | A * | 4/1995 | Eisele | 256/24 |
| 5,421,557 | A * | 6/1995 | Vise | 256/24 |
| 5,441,239 | A * | 8/1995 | Watson | 256/1 |
| 5,457,911 | A * | 10/1995 | Vollink | 47/67 |
| 5,548,911 | A * | 8/1996 | Myers | 40/308 |
| 5,556,080 | A * | 9/1996 | Vise | 256/24 |
| 5,794,390 | A * | 8/1998 | Oliveri et al. | 52/177 |
| 5,794,922 | A * | 8/1998 | Meglino et al. | 256/34 |
| 5,799,929 | A * | 9/1998 | Meglino et al. | 256/34 |
| 5,853,167 | A * | 12/1998 | West et al. | 256/66 |
| 5,901,482 | A * | 5/1999 | Sawyer et al. | 40/308 |
| 6,126,146 | A * | 10/2000 | Melton | 256/34 |
| 6,152,428 | A * | 11/2000 | Simioni | 256/24 |
| 6,712,340 | B1 * | 3/2004 | Clarmont | 256/19 |
| 6,719,276 | B1 * | 4/2004 | Bush | 256/1 |
| 7,004,480 | B2 * | 2/2006 | Trubiano | 280/33.992 |
| 7,216,853 | B2 * | 5/2007 | Wall | 256/24 |
| 7,240,637 | B2 * | 7/2007 | Rosen | 119/524 |
| 2002/0083628 | A1 * | 7/2002 | Magid | 40/308 |
| 2004/0163295 | A1 * | 8/2004 | Fontana et al. | 40/617 |

* cited by examiner

*Primary Examiner* — Joshua T Kennedy

(74) *Attorney, Agent, or Firm* — Tutunjian & Bitetto, P.C.; James J. Bitetto

(57) ABSTRACT

A fence covering system includes a frame configured and dimensioned to cover a portion of an existing fence. A panel is connected to the frame to provide a visual effect. A connector secures the frame on a portion of the fence, the connector providing an attachment position for the frame.

8 Claims, 33 Drawing Sheets

FENCE COVERING SYSTEM

RELATED APPLICATION DATA

This application claims priority to Provisional Application Ser. No. 60/466,949, filed May 2, 2003, which is incorporated herein by reference.

FIELD OF THE INVENTION

The present invention relates generally to fence covering systems, and in particular, to an apparatus and method for mounting onto and covering at least one side of existing or new fences.

SUMMARY OF THE INVENTION

A fence covering system includes a frame configured and dimensioned to cover a portion of an existing fence. A panel is connected to the frame to provide a visual effect. A connector secures the frame on a portion of the fence, the connector providing an attachment position for the frame.

Advantageously, the present invention provides an efficient, convenient and relatively inexpensive way of converting, for example, a "plain" see-through chain-link fence or other fence into a fence offering more privacy, noise reduction and an immediate upscale and decorative appearance. Such effect is achieved without the hassle and expense of excavating an existing fence, and in the case of new fences to be constructed, standard fence posts, piping and fittings provide a sufficient frame onto which a fence covering system according to the present invention may be mounted.

Further, the fence covering system according to the present invention is easily removable, so that alternate designs and configurations may be freely interchanged and installed as desired. Advantageously, the present invention may be adapted to be used with virtually any type of fence or fence frame, and is not limited to use with, e.g., chain-link fences.

BRIEF DESCRIPTION OF THE DRAWINGS

This disclosure will present in detail the following description of preferred embodiments with reference to the following figures wherein:

FIGS. 6A-6L are perspective views showing a plurality of different assemblies to be employed in accordance with embodiments of the present invention;

DETAILED DESCRIPTION OF PREFERRED EMBODIMENTS

Figure 1A:
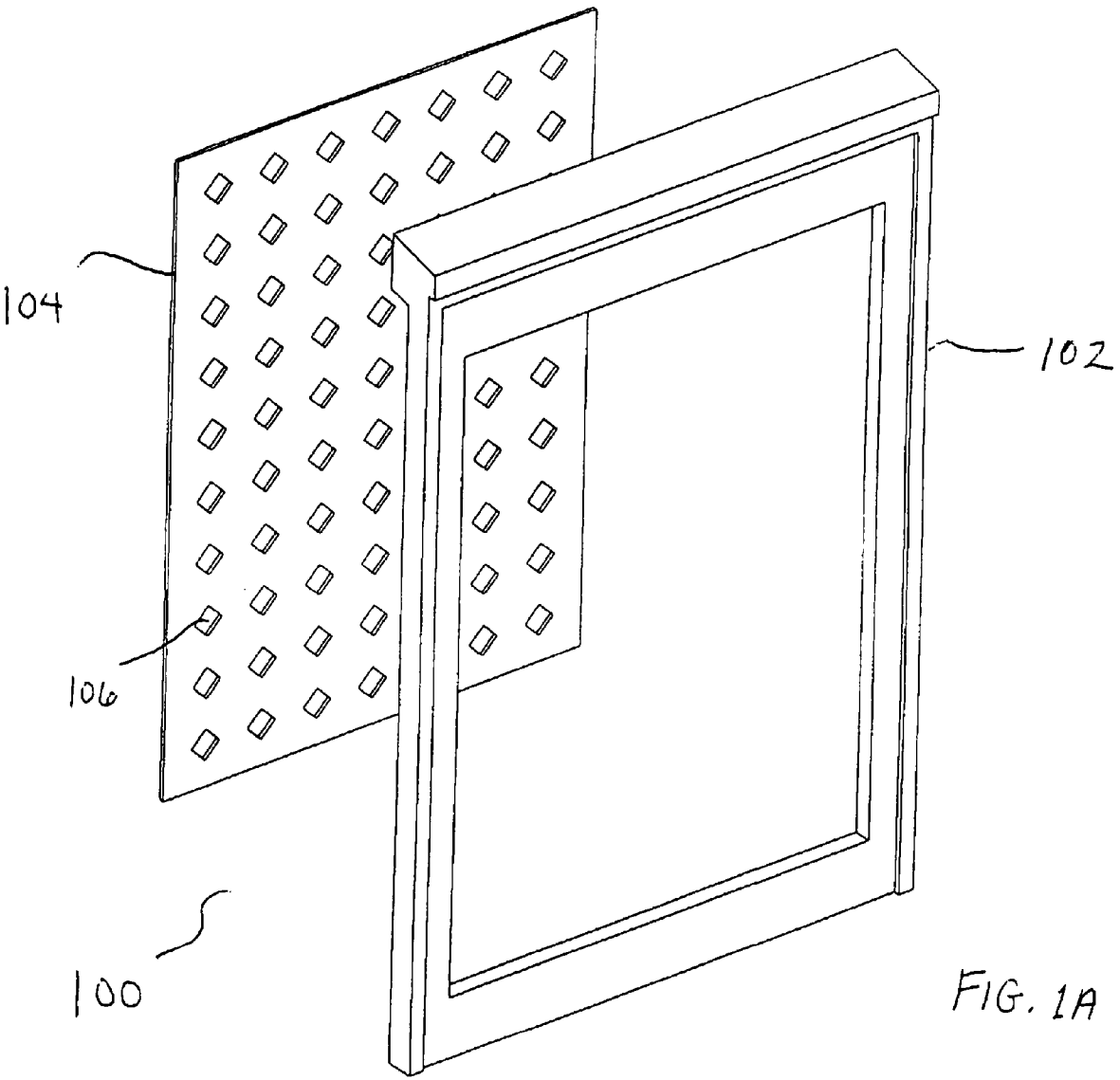
FIG. 1A is an exploded perspective view showing a panel frame and panel in accordance with one embodiment of the present invention.
Figure 1B:
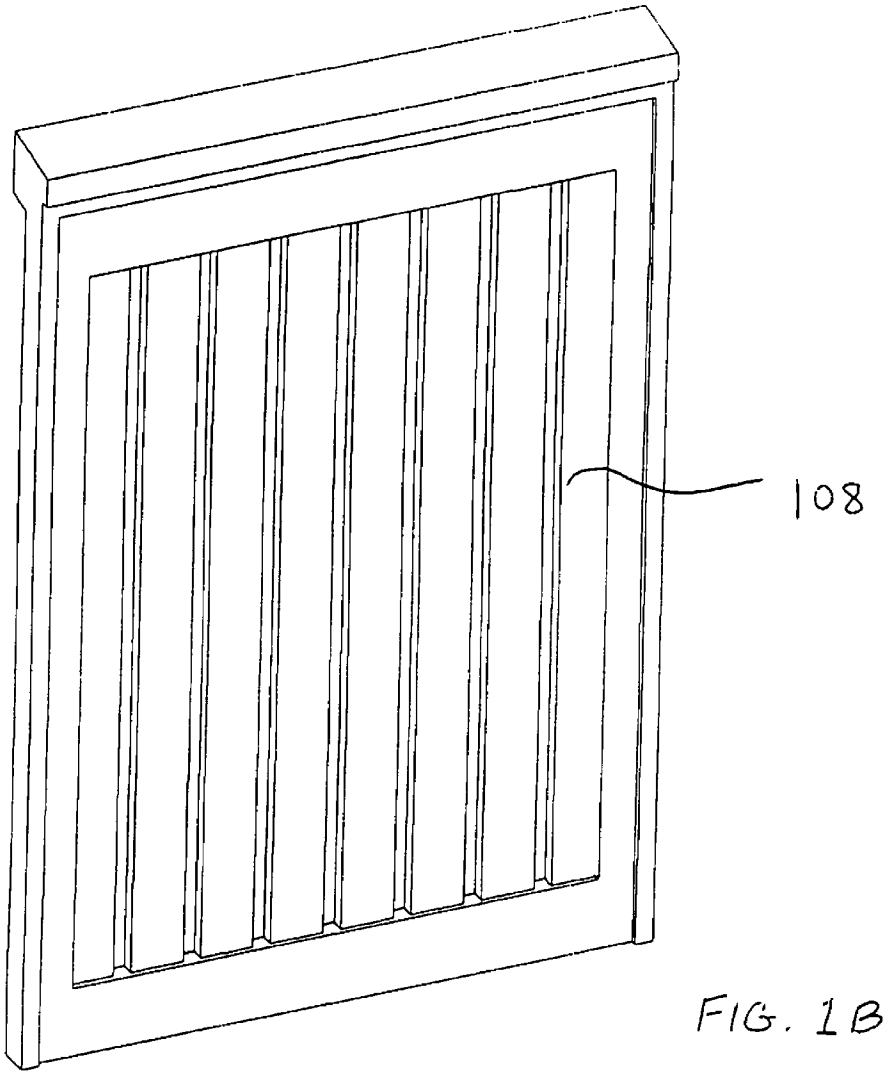
FIG. 1B is an assembled perspective view showing a panel frame and panel in accordance with an embodiment of the present invention.

FIGS. 1A and 1B depict an exemplary fence covering panel 100 according to an aspect of the present invention. Preferably, the fence covering panel 100 is constructed of a rigid but somewhat flexible and resilient material, e.g., aluminum, vinyl, plastic, etc. In one embodiment, the present invention is generally comprised of at least one panel frame 102 having an interior panel 104 fitted therein which may include, e.g., optional openings/perforations 106, etc. It is to be noted that the interior panel 104 may include, for example, various graphics (e.g., "artwork") on its outer face. In addition, the interior panel 104 may be constructed in various configurations and designs (e.g., picket or slot designs 108).

FIGS. 2A-2G show various alternative embodiments wherein two of the fence covering panels 100 are combined to be fitted over both sides of a chain-link fence 200. It is to be noted that the chain link fence 200 shown here is for exemplary purposes only and use of the present invention with other types of fences may be contemplated.

In one embodiment, each covering panel 100 is placed over either side of the fence 200 and then joined to each other at, for example, a top end via, e.g., snaps, screws, bolts, etc. (not shown). In another embodiment, as shown e.g., in FIGS. 2B and 2C, one or more pairs of mounting plates 202 are first installed and fixed onto the fence 200 or a top fence bar 201 via, e.g., snaps, screws, etc. At least one of the pair of mounting plates 202 may include, for example, protrusions 204 shaped to at least fit through, for example, links of the chain-link fence 200, and be mated with appropriately shaped receiving cavities (not shown) on a corresponding mounting plate 202 on the other side of the fence (see FIG. 2D). Alternatively, at least one of a pair of mounting plates 202 may be adapted for attachment on the top fence bar 201 (e.g., may have a hollow cavity formed therein shaped to receive a portion of the top fence bar 201) and then be attached to a corresponding mounting plate 202 on the other side of the top fence bar 201. In these ways, for example, each mounting plate 202 may be snapped into place and secured onto the fence 200 as well as be secured to each other.

Figure 2A:
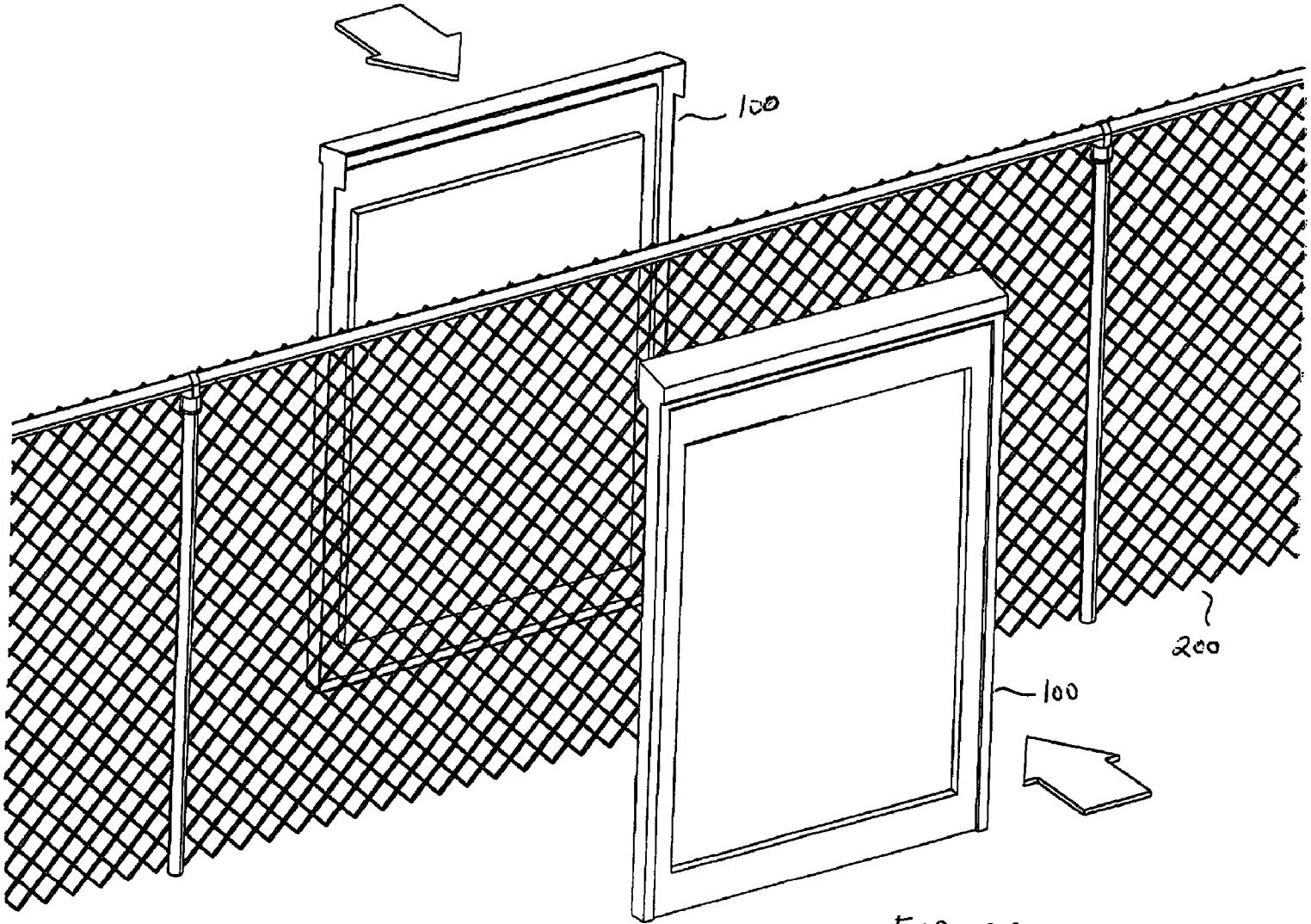
FIGS. 2A-G are perspective views showing panel frames being assembled on a chain link fence in accordance with different embodiments of the present invention.
Figure 2B:
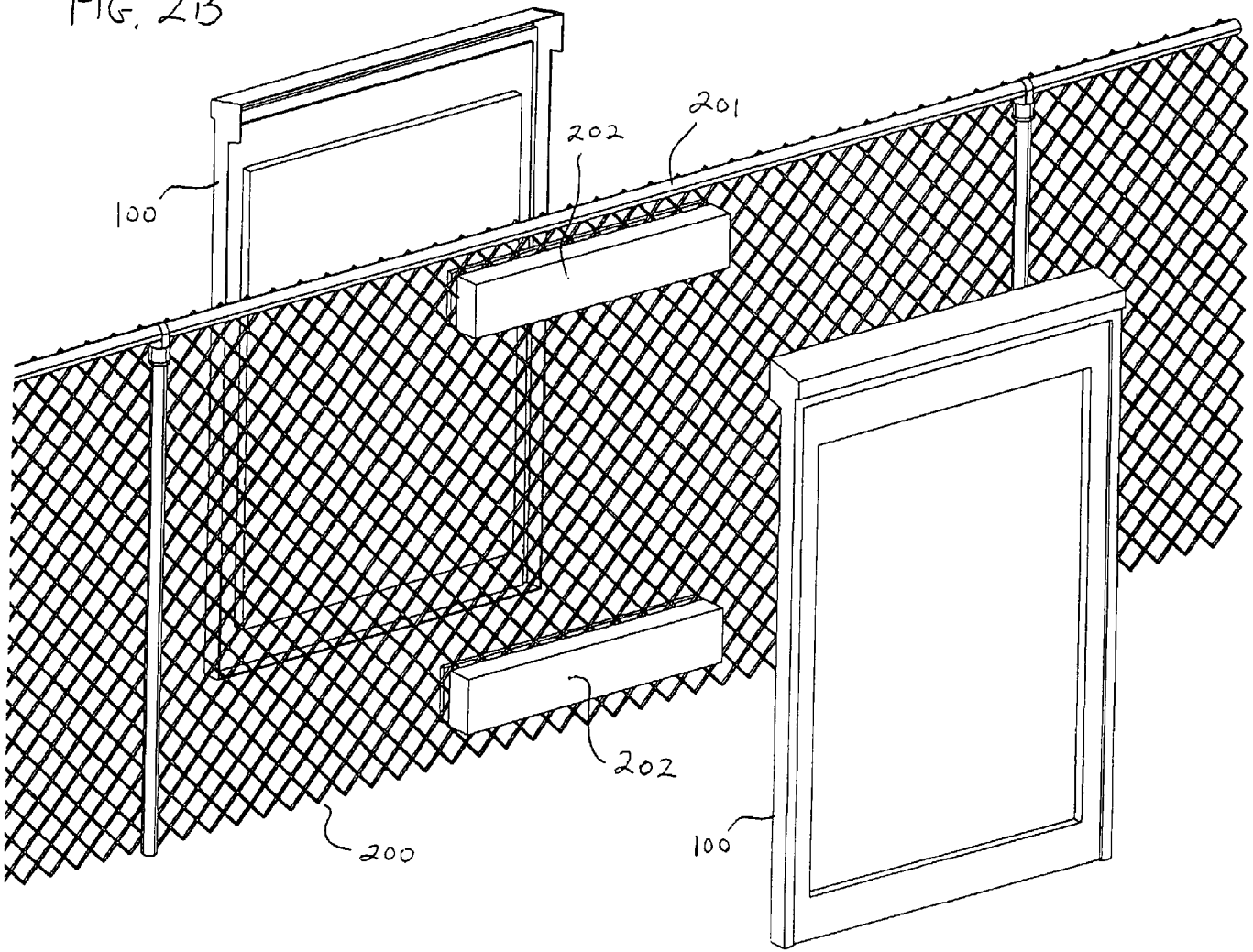
Figure 2C:
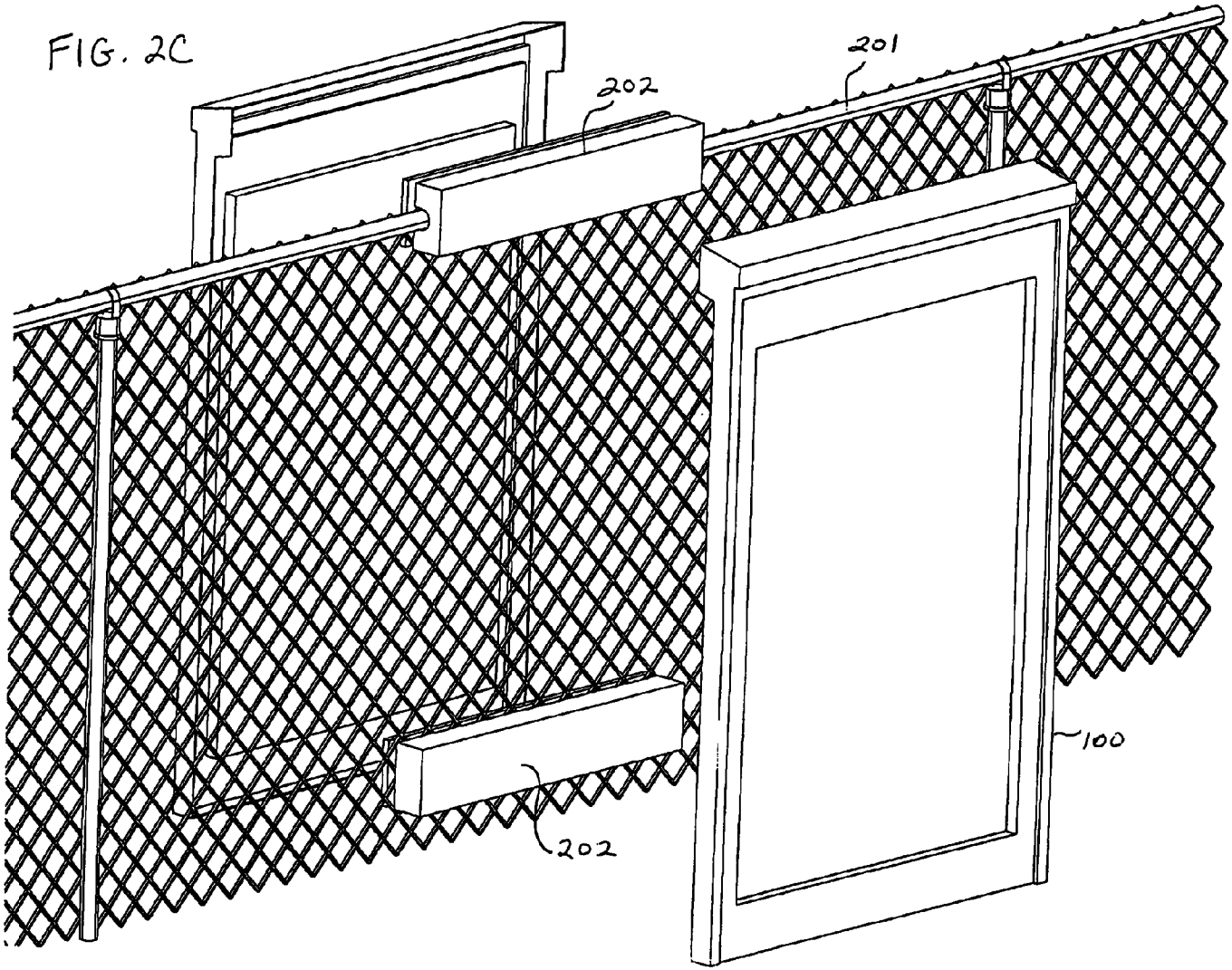
Figure 2D:
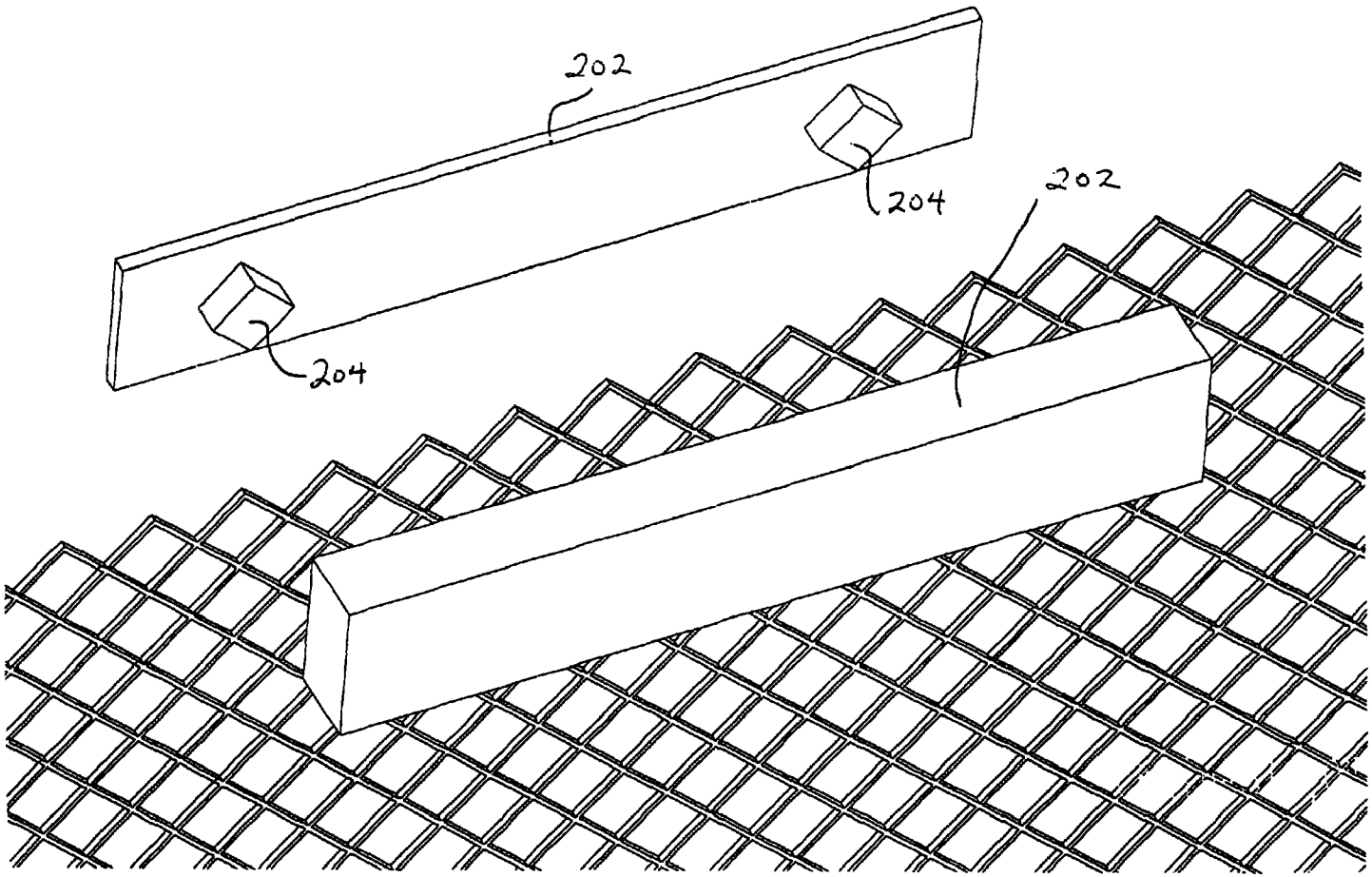
Figure 2E:
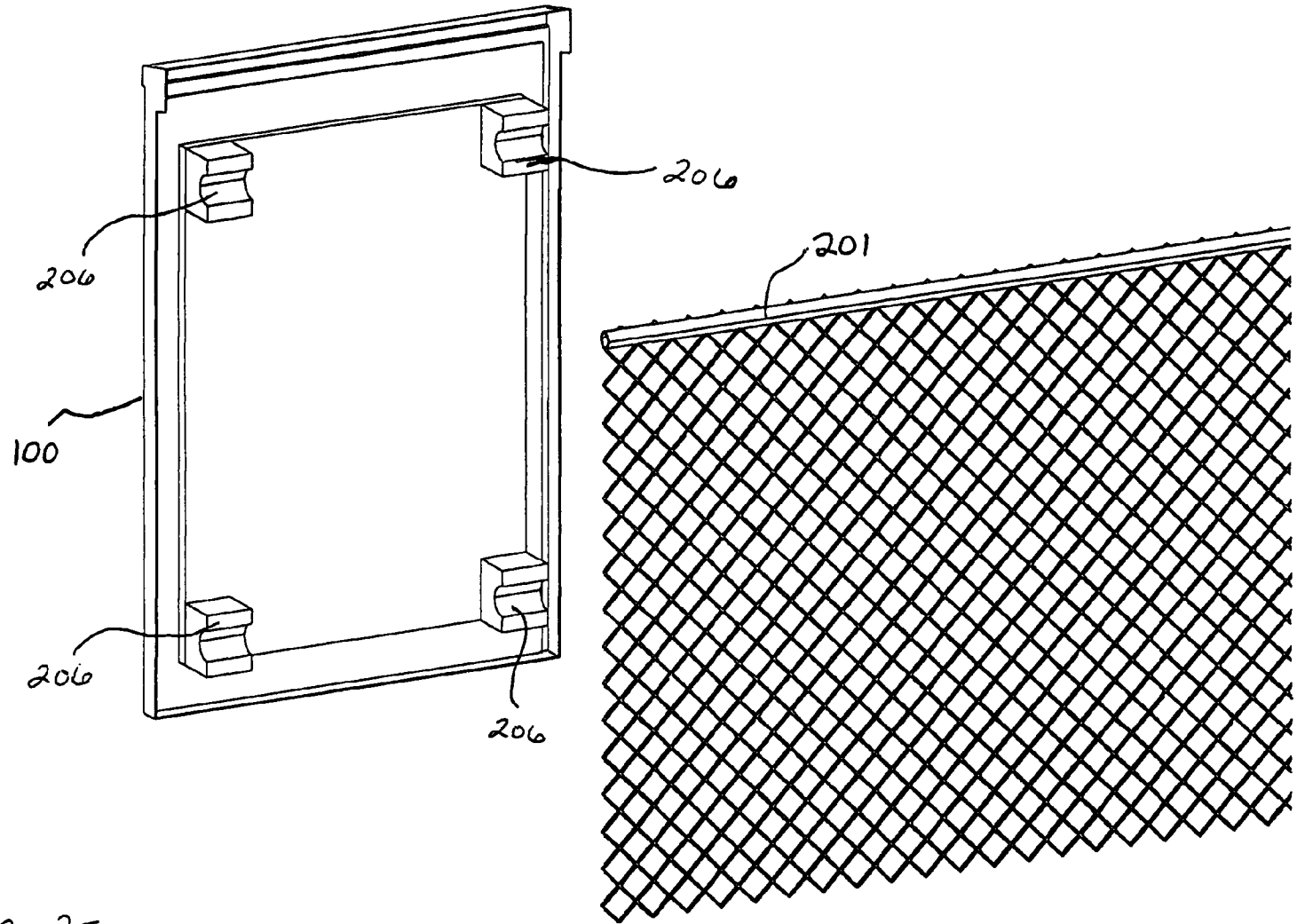

In yet another alternate embodiment, it is to be noted that each covering panel 100 may include attachment points for attachment of various mounting plates 206 thereon as desired (e.g., plates mounting over fence bar 201 or through the chain-link fence 200) that are removable and independently interchangeable as desired (see FIG. 2E).

Next, each covering panel 100 can then be attached to the fence 200 via each installed mounting plate 202. For example, each covering panel 100 may be snapped, screwed onto, or otherwise fastened onto each mounting plate 202. The mounting plates 202 also serve to ensure and simplify correct alignment of each covering panel 100 with each other and with respect to the fence 200 prior to installation of each covering panel 100.

Figure 2F:
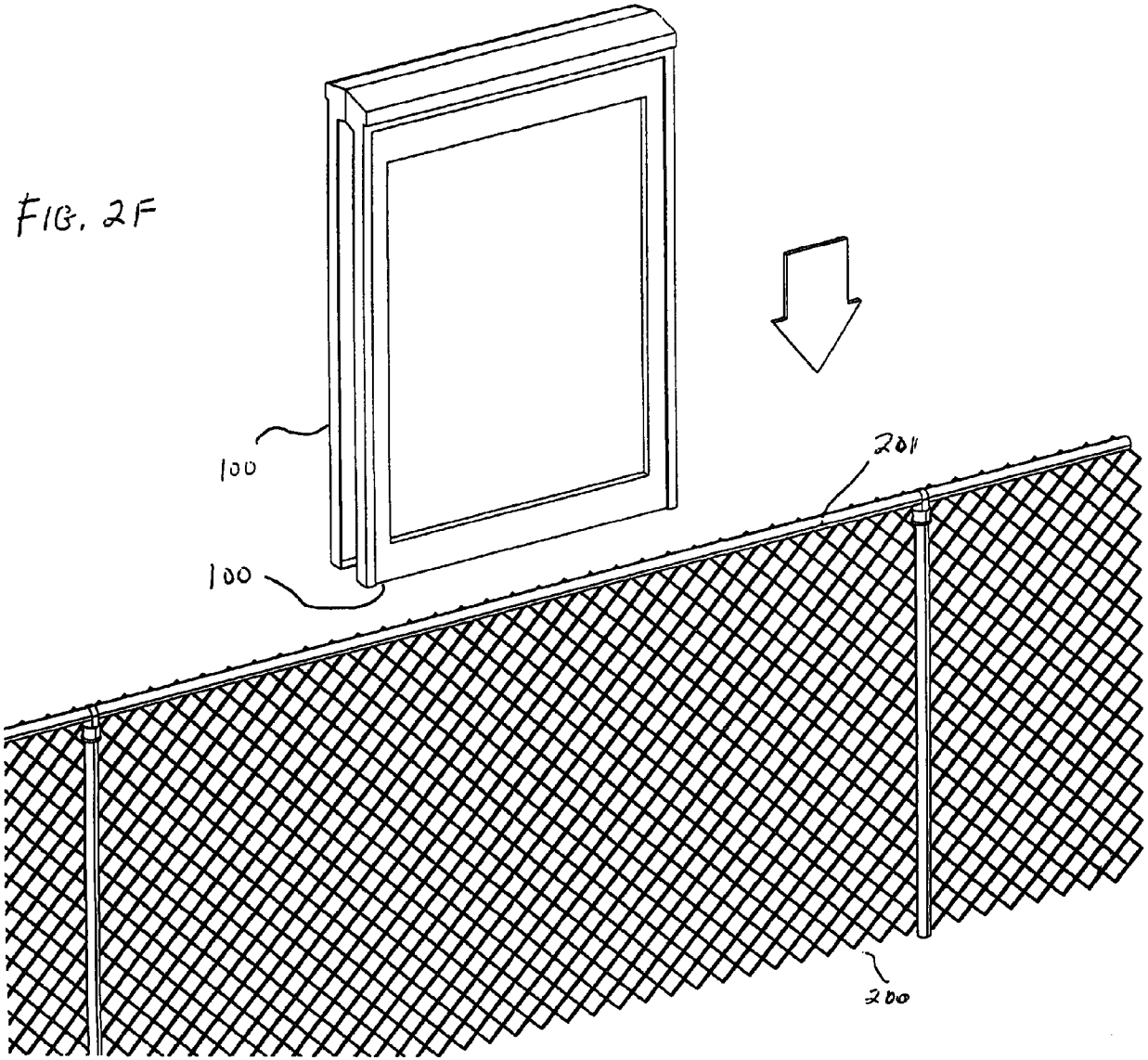
Figure 2G:
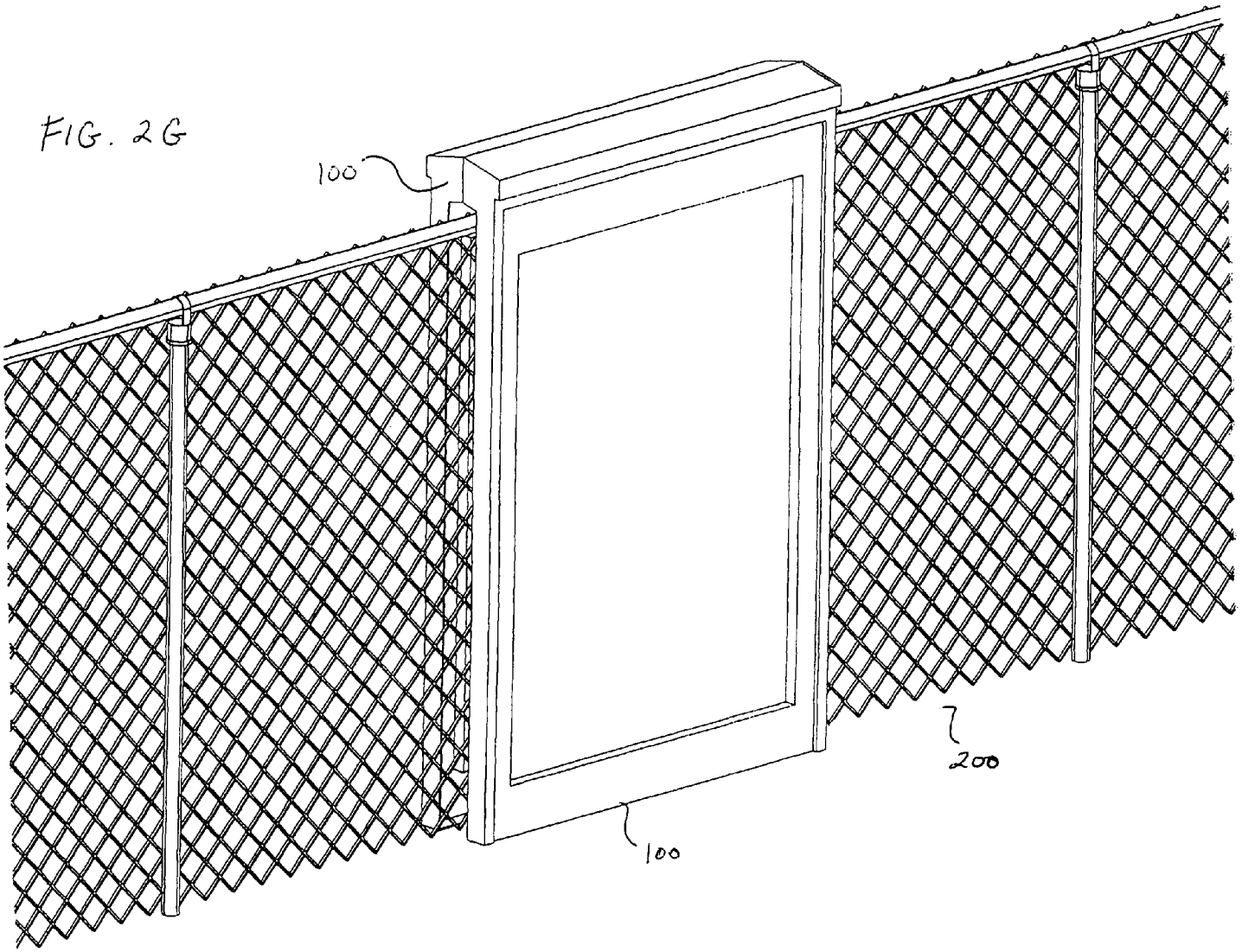

In yet another embodiment, each covering panel 100 is first attached to each other at a top end (via, e.g., screws, snaps, etc.) and then slidably installed over the fence 200 (see FIG. 2F). FIG. 2G shows a segment of two fence covering panels 100 according to the present invention as installed on, for example, both sides of the chain-link fence 200. It is to be noted that each of the fence covering panels 100 may include a fastening means (not shown) to secure the panels 100 to the fence 200. Such fastening means may comprise, e.g., a clip to secure the bottom of each panel 100 to the bottom of the fence 200. Alternately, two covering panels are integrally formed to provide a single piece, which can be fitted over the top of a fence 200. The two panels may be hingedly connected to fit over the fence and be attached to or through the fence at a lower portion.

Figure 3:
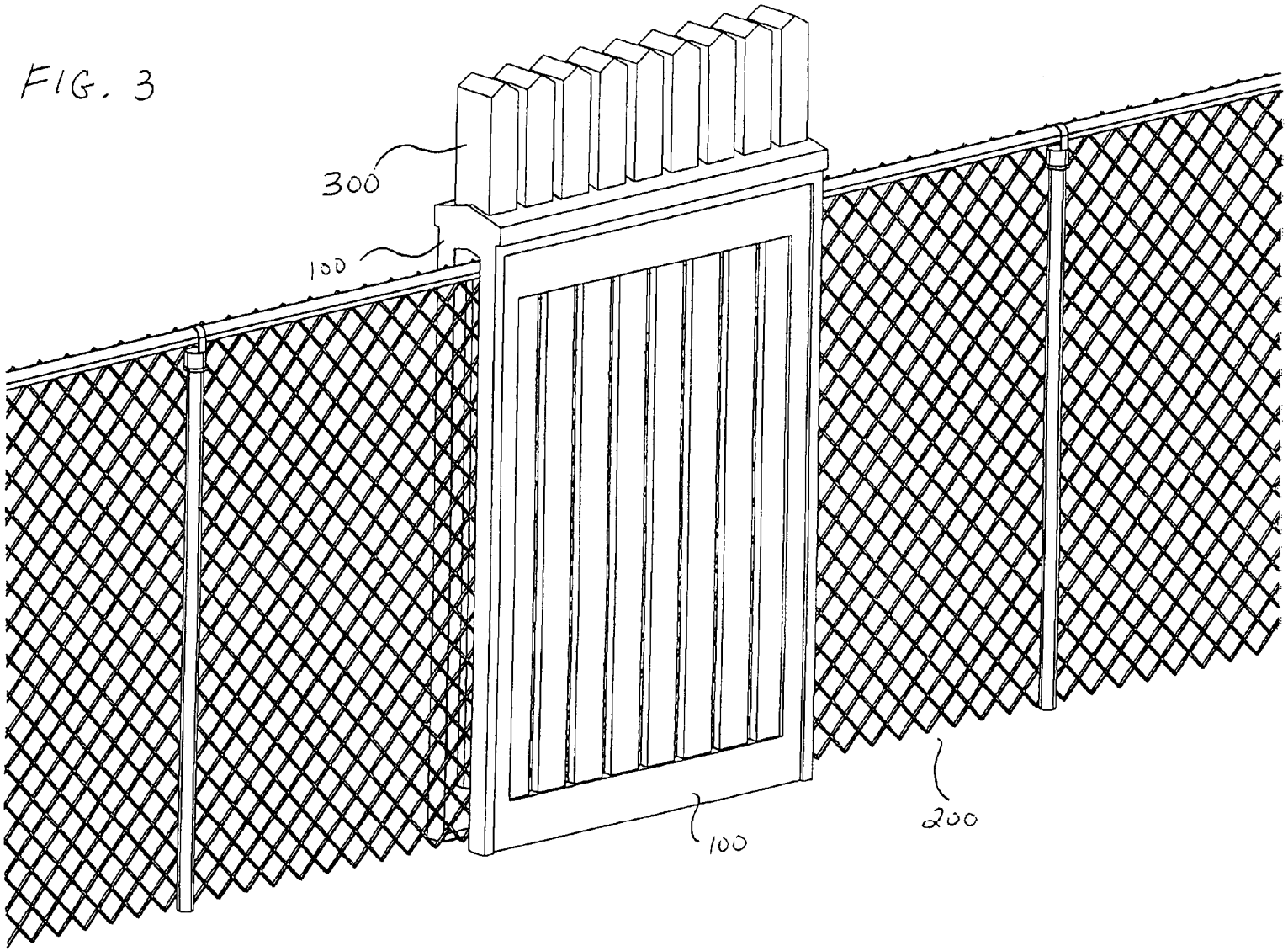
FIG. 3 is an assembled perspective view showing a panel frame with additional height in accordance with an embodiment of the present invention.

FIG. 3 depicts an exemplary embodiment of the fence covering panel 100 having an optional extended detailing feature 300 according to an aspect of the present invention. The detailing 300 may comprise, e.g., railings, posts, arches, walls, etc. in any shape, size or configuration to extend the height of the overall fence as desired.

Figure 4A:
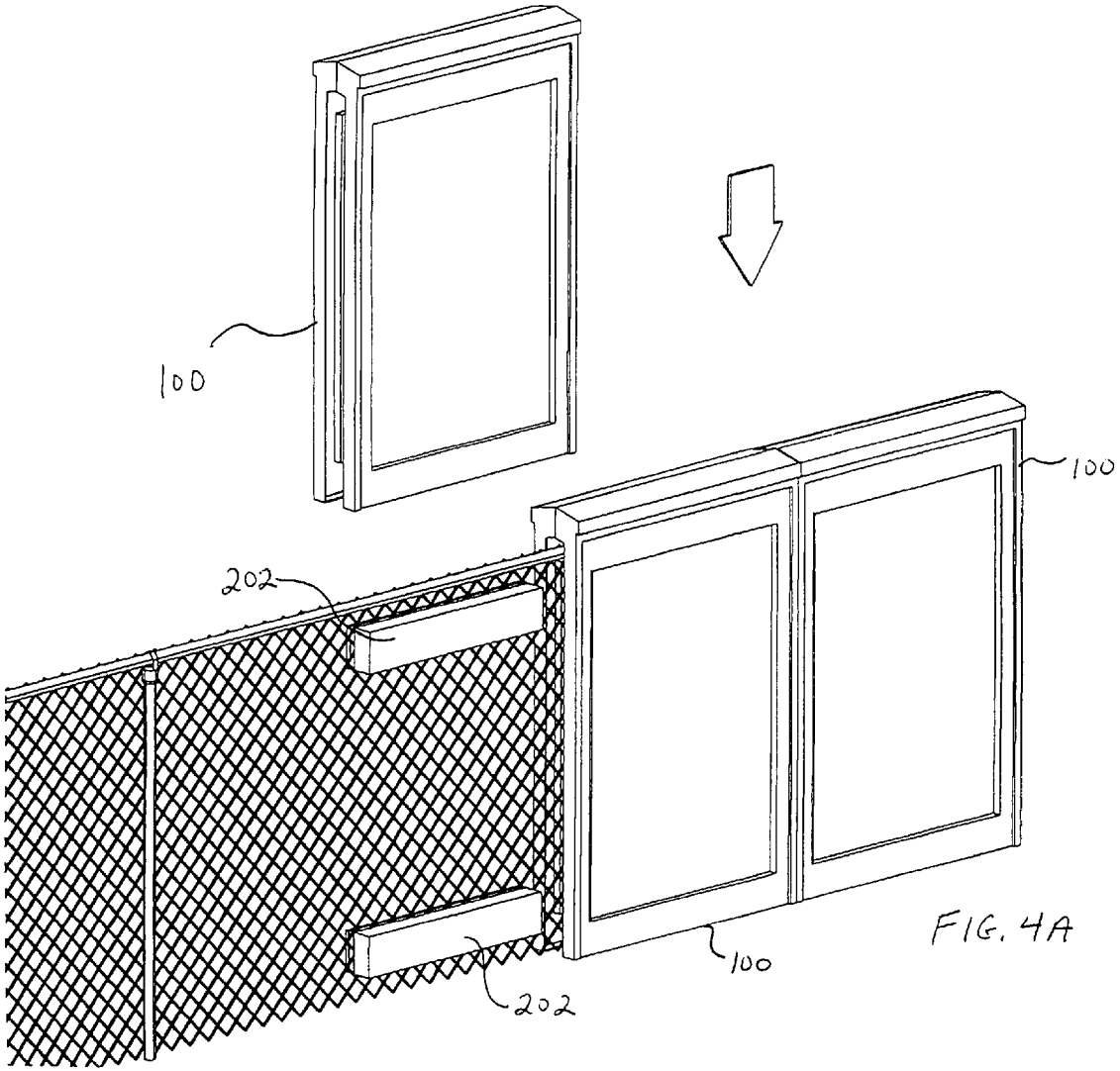
FIG. 4A is a perspective view showing panel frames cascaded in accordance with an embodiment of the present invention.
Figure 4B:
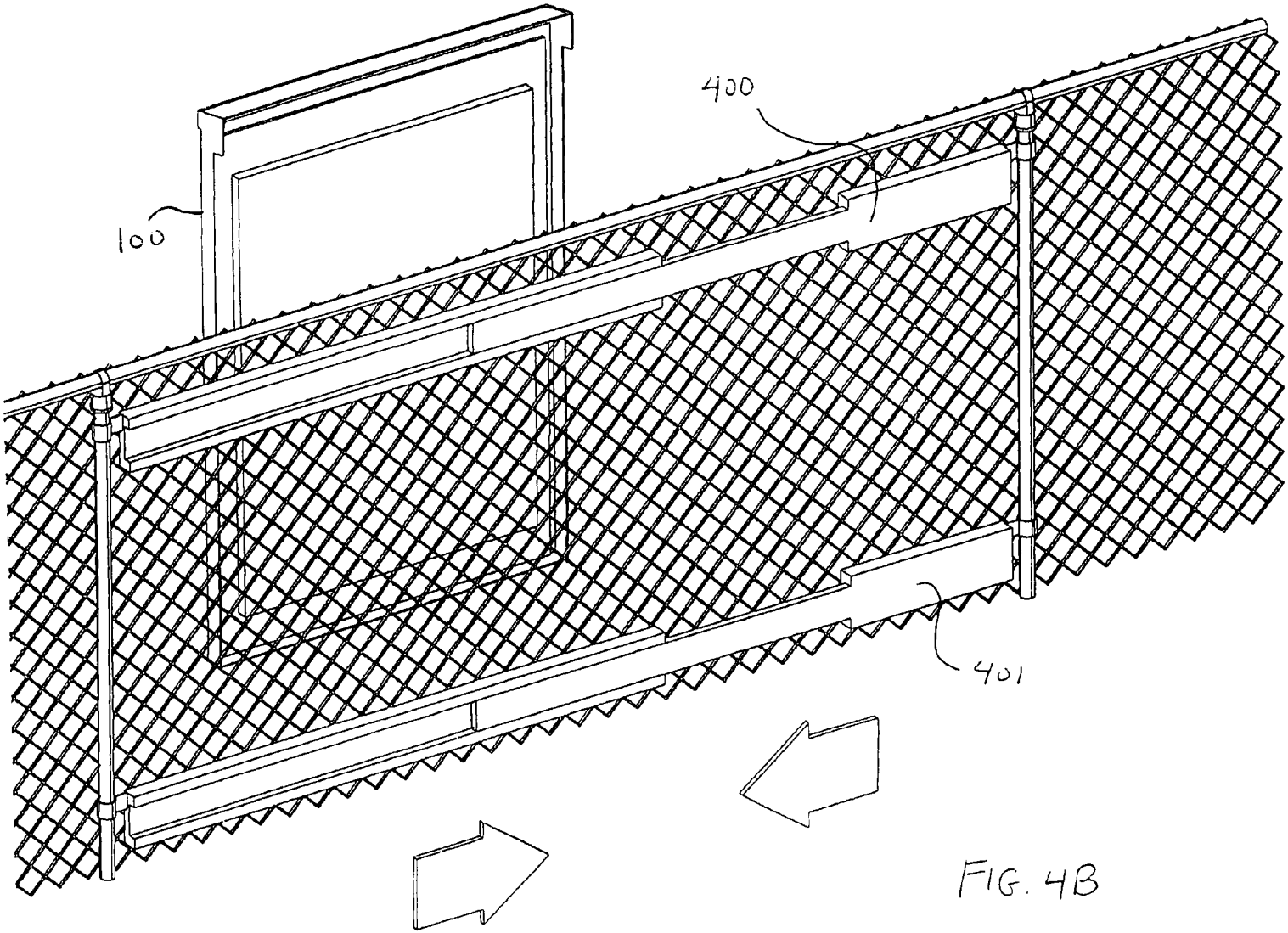
FIGS. 4B and 4D are perspective views showing adjustable mounting plates in accordance with an embodiment of the present invention.

FIGS. 4A and 4B show exemplary arrangements wherein multiple fence covering panels 100 are installed on either sides of the fence 200 as well as adjacent to each other along the fence 200. It is to be noted that the fence covering panels 100 may include, e.g., interlocking/mating features (not shown) for side-by-side attachment to each other when they are adjacently installed.

Figure 4C:
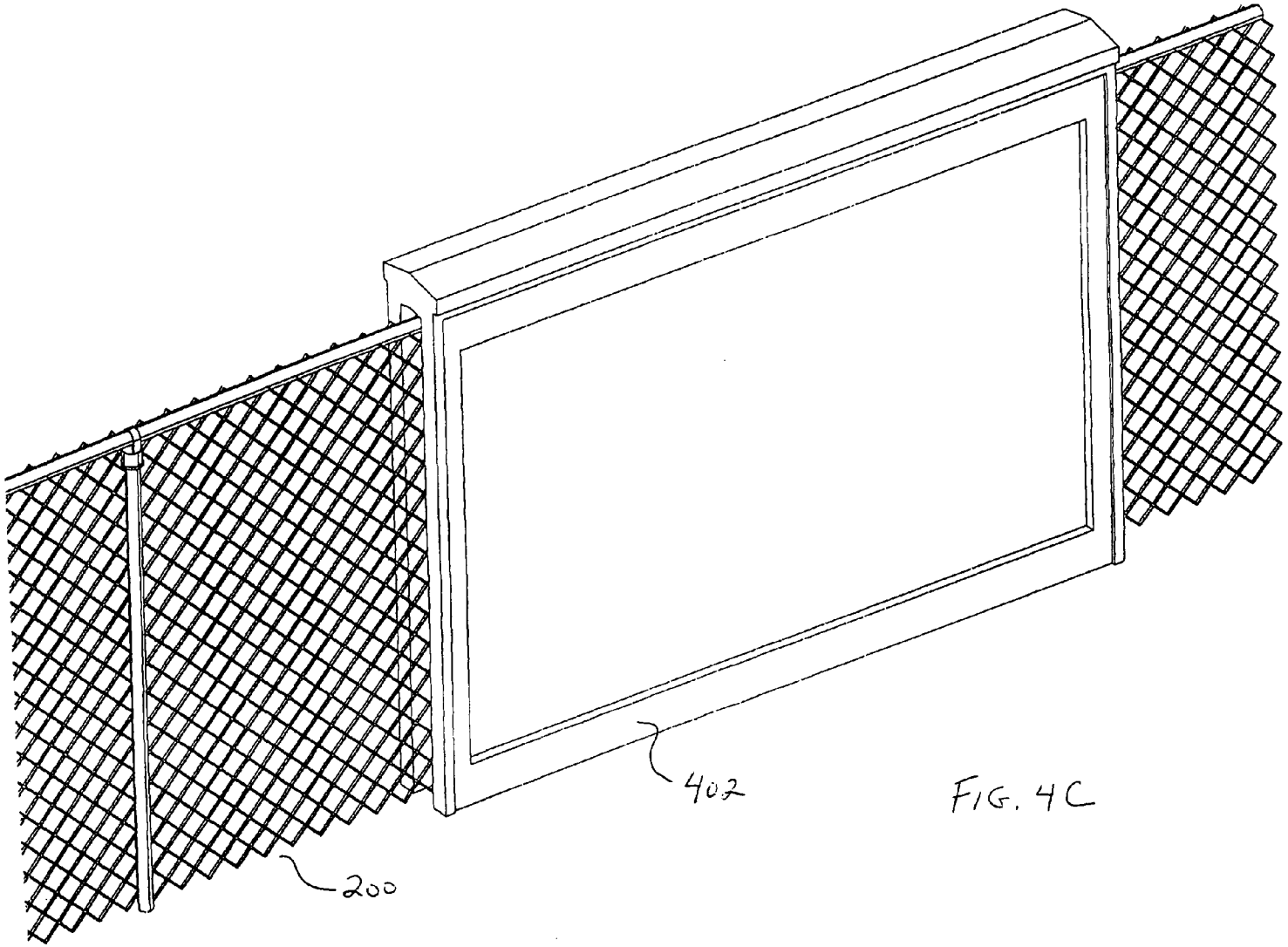
FIG. 4C is a perspective view showing a panel frame mounted on a chain link fence in accordance with an embodiment of the present invention.

The installation of the panels 100 onto the fence 200 may be accomplished using, e.g., individual mounting plates 202 as described above or upper and lower adjustable mounting plates 400 and 401, respectively. The upper and lower adjustable mounting plates 400 and 401 may be, for example, slideable to provide for adjustment of their length as desired along each side of the fence 202 (see FIG. 4B). Thus, in an alternate embodiment as shown in FIG. 4C, a single extended fence covering system 402 may be installed onto the fence 200 on appropriately extended adjustable mounting plates 400 and 401 (not shown).

Figure 4D:
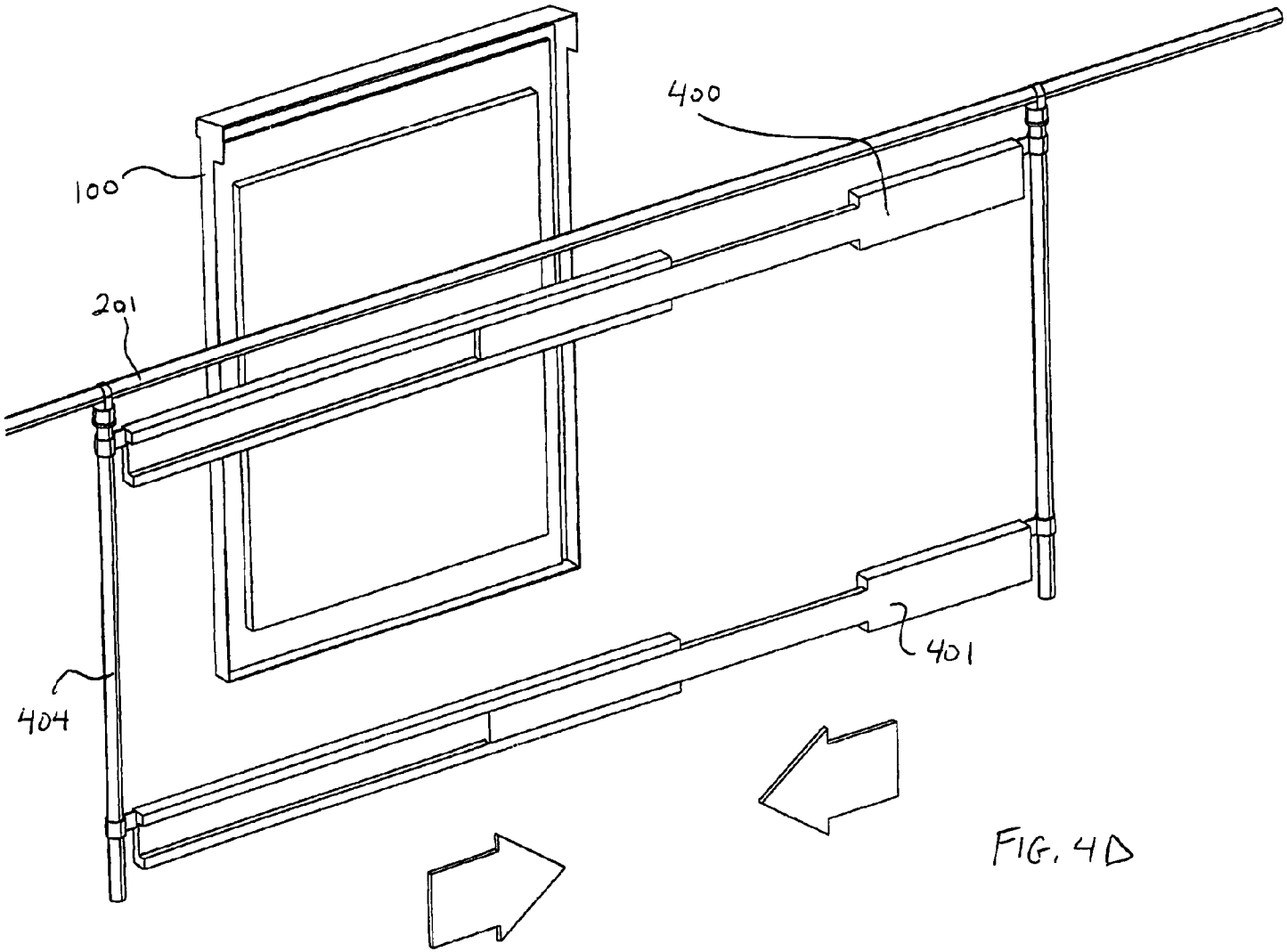
Figure 4E:
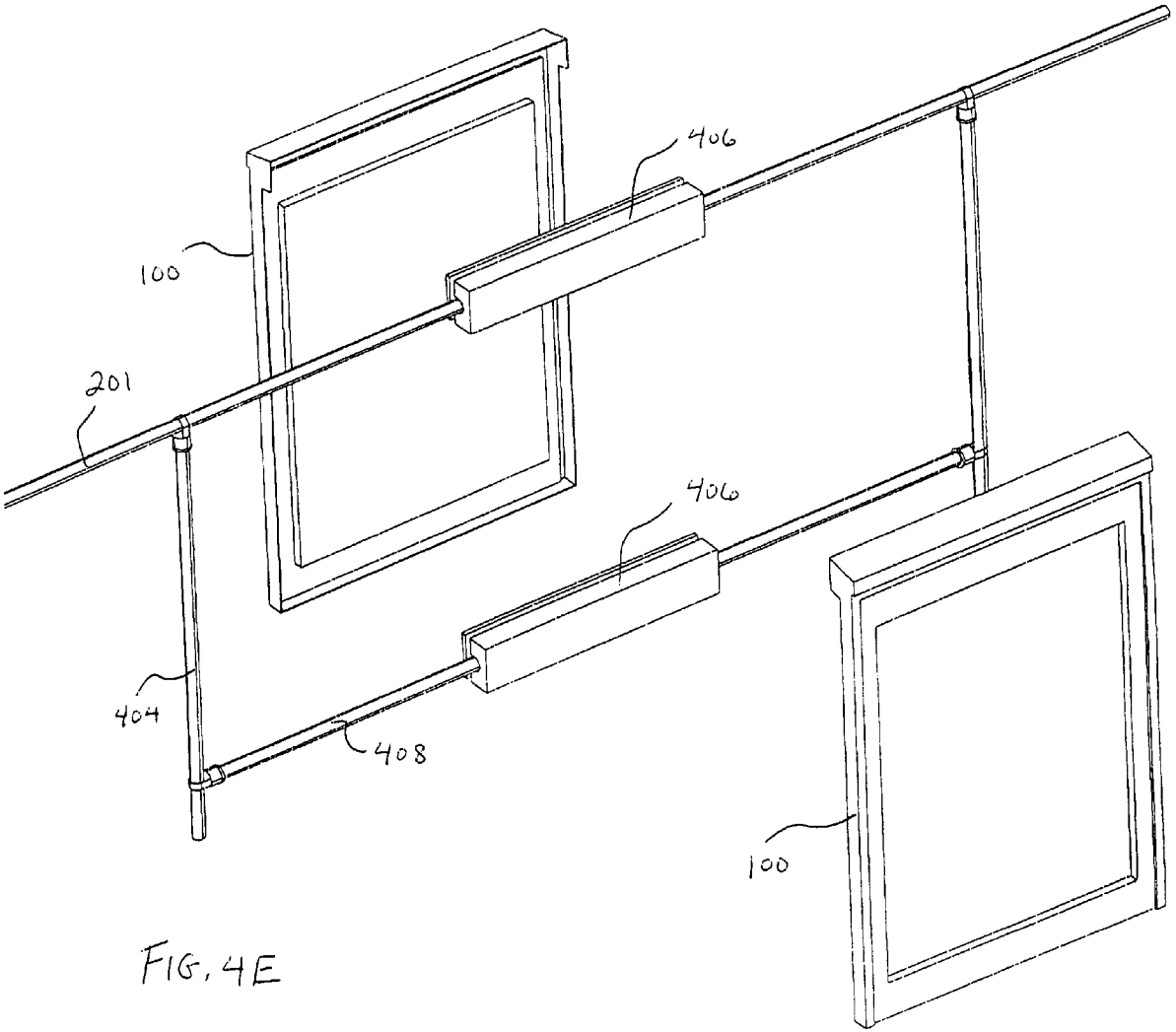
FIG. 4E is a perspective view showing mounting plates secured to poles of a fence in accordance with one embodiment of the present invention.

In yet another alternate embodiment, FIG. 4D depicts installation of upper and lower adjustable mounting plates 400 and 401 on a standard fence frame comprising fence posts 404 and top fence bar 201. It is to be noted that in this embodiment, the lower adjustable mounting plate 401 may be used alone without an additional bottom fence bar for reinforcement. FIG. 4E shows yet another embodiment wherein frame mounting plates 406 are installed onto the top fence bar 201 and a bottom fence bar 408 for mounting of the fence covering panels 100.

Thus advantageously, it is to be noted that it is not required to construct an actual fence in its entirety for installation and attachment of a fence covering system according to the present invention. Instead, a simple fencing frame can provide sufficient structural support for installation, mounting and utilization of the present invention.

Figure 5A:
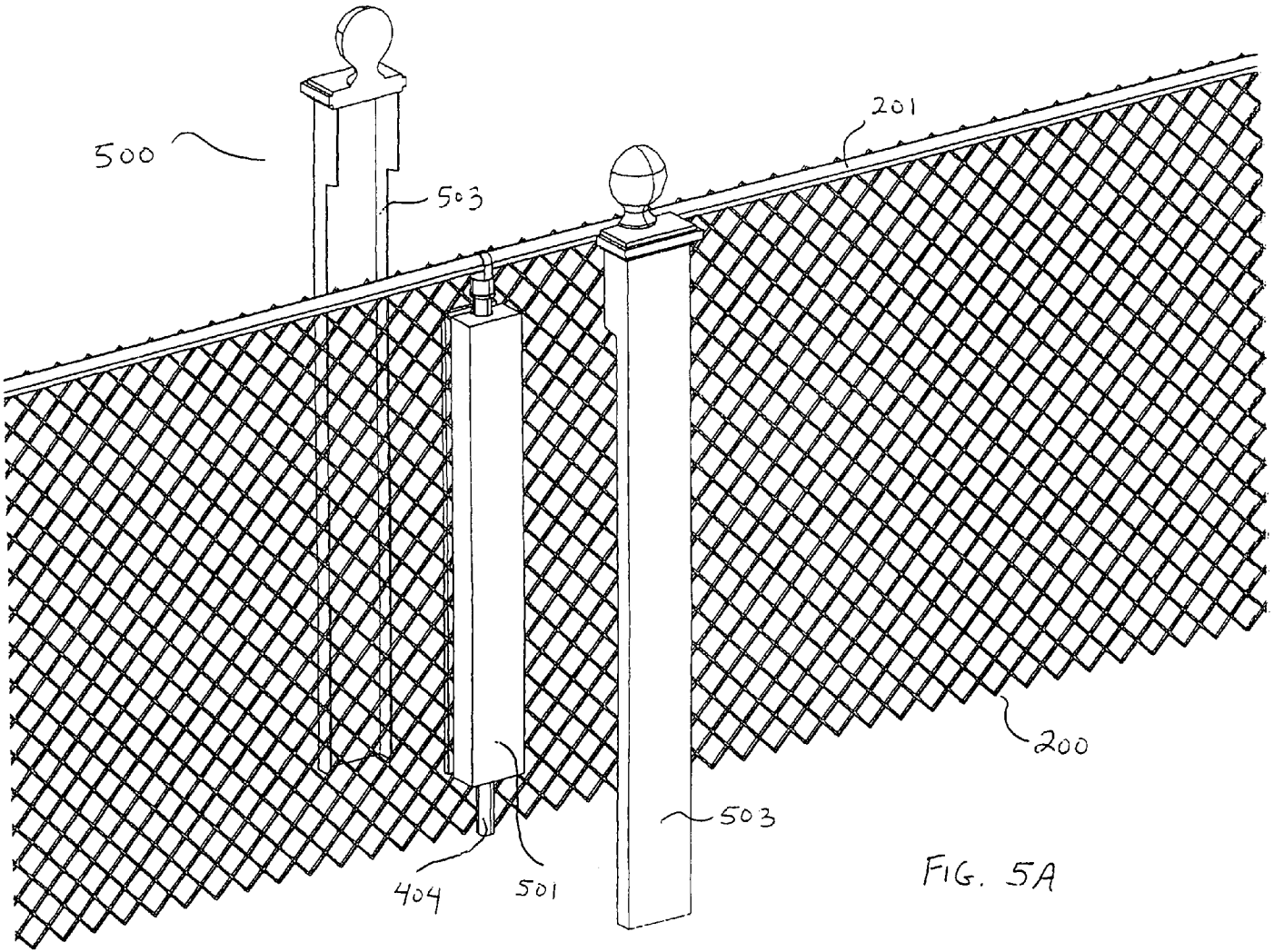
FIGS. 5A-C are perspective views showing adjustable pole covers and ornamental poles used in accordance with an embodiment of the present invention.
Figure 5B:
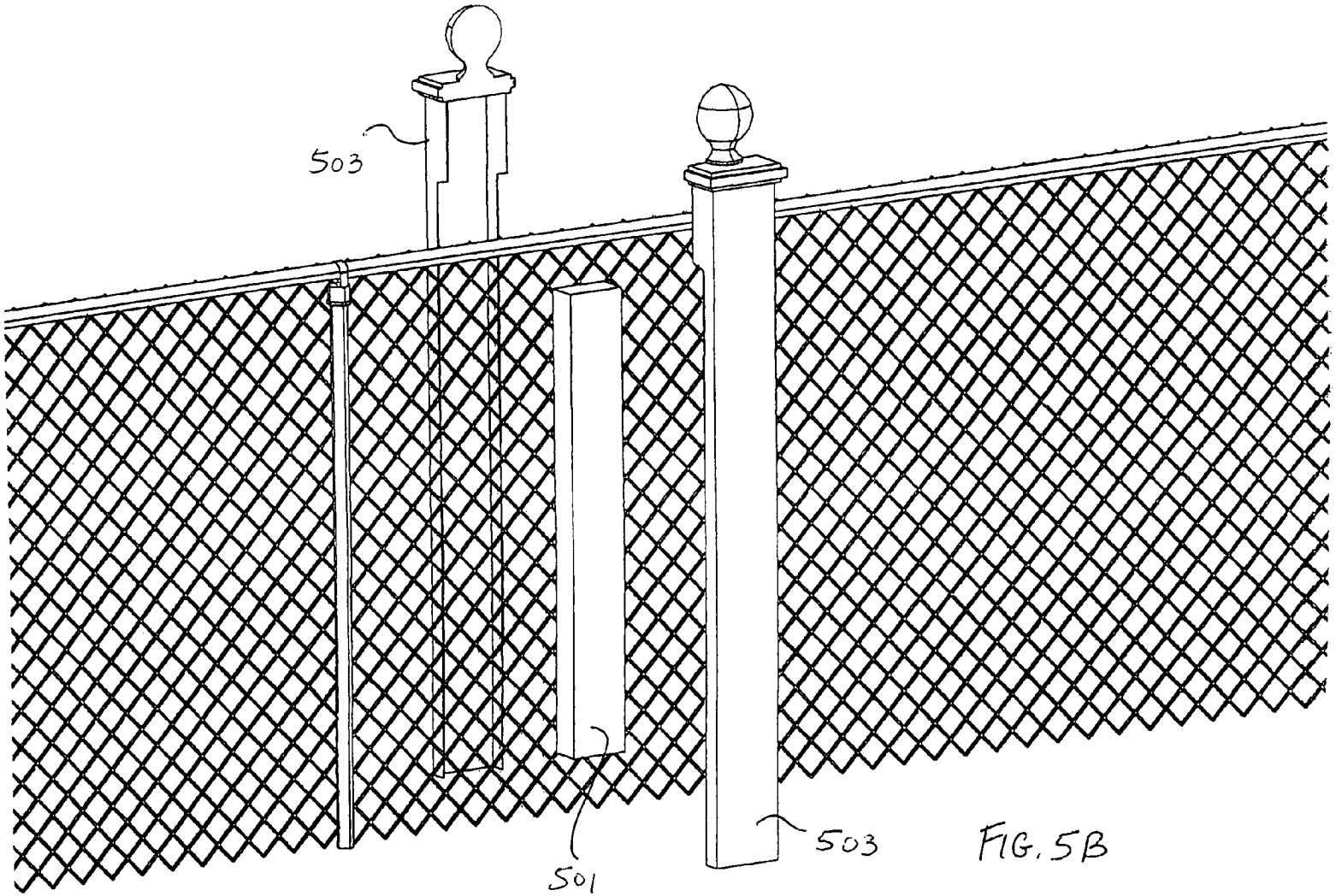
Figure 5C:
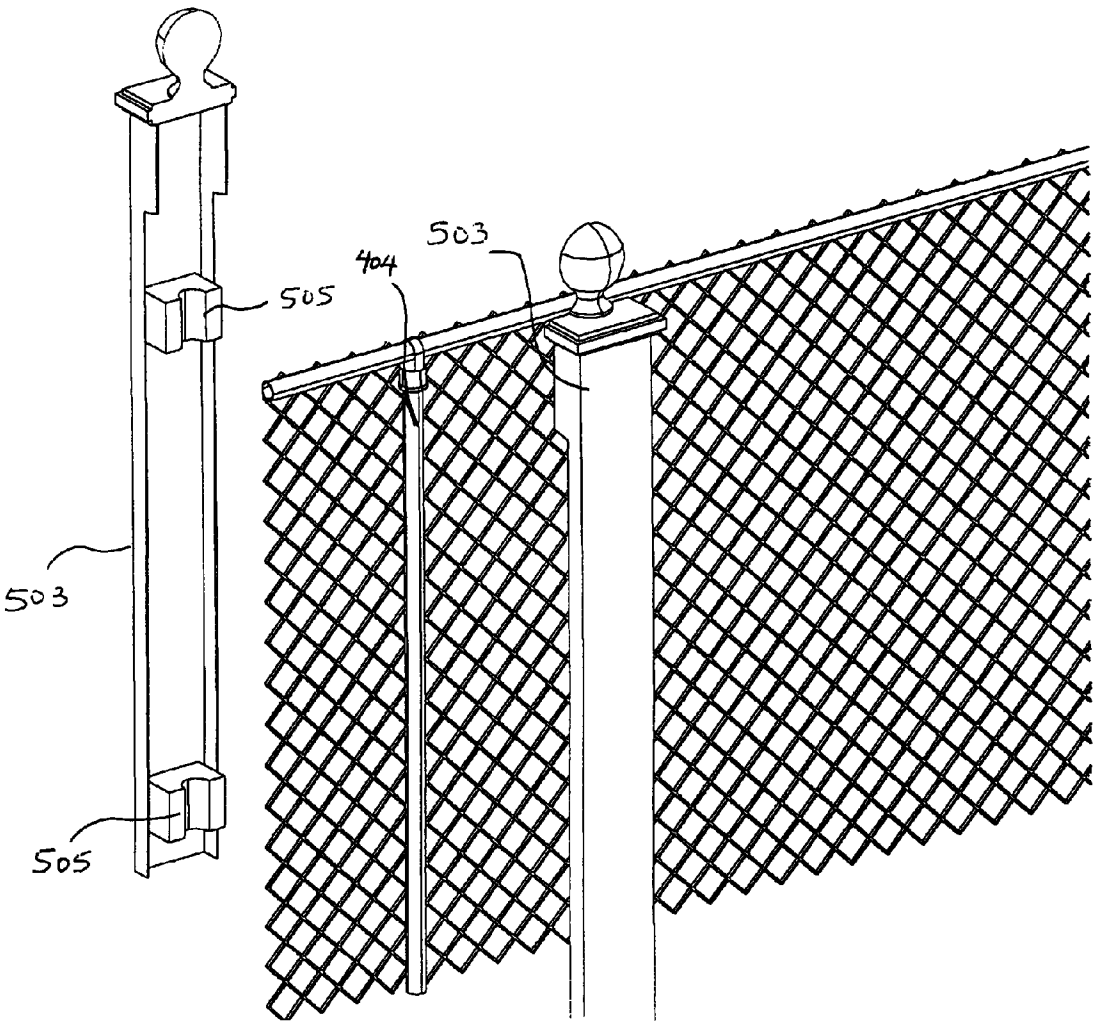

FIGS. 5A-5C show exemplary embodiments wherein a fence post covering system 500 is installed onto a fence 200. It is to be noted that the fence post covering system 500 may be used to cover fence posts or fences of any type, and is not limited to chain-link fences. In one embodiment, the fence post covering system 500 is comprised of at least one fence post mounting plate 501 and at least one fence post covering panel 503. It is to be noted that the mounting plate 501 may be adapted so as to be removably attachable to a fence post (see FIG. 5A) or at any point along the fence (see FIG. 5B). In another embodiment as shown in FIG. 5C, each fence post covering panel 503 includes removable mounting pieces 505 attached therein that are shaped/positioned accordingly for attachment of the panel 503 to the fence post 404 or to any point along the fence 200.

FIGS. 6A-6L depict various embodiments of a combined fence and fence post covering system according to the present invention. It is to be noted that the fence and fence post covering system may be adapted for use on either one of both sides of the fence 200 as desired. Preferably, each of the components of the fence and fence post covering system is constructed of a rigid but somewhat flexible and resilient material, e.g., aluminum, vinyl, plastic, etc.

Figure 6A:
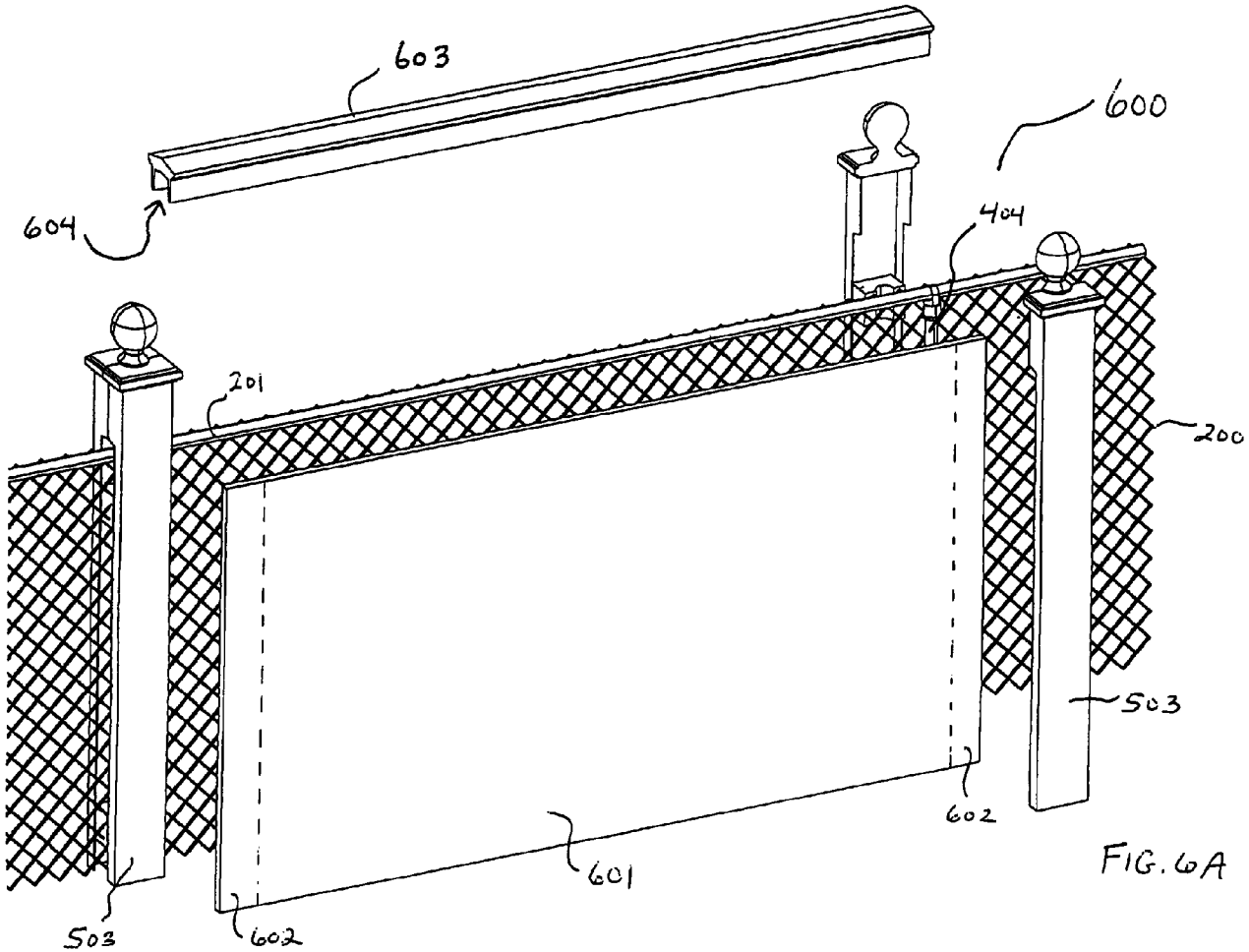

In FIG. 6A, a combination fence and fence post covering system 600 is shown comprising fence post coverings 503, a side panel 601 and a cap 603. The fence post coverings 503 may be attached to each fence post 404 via e.g., fence post mounting plates 501 or mounting pieces 505, as described above. The side panel 601 is preferably cut and sized to fit between each post covering 503 and may be attached to the fence 200 by e.g., partially inserting/sliding each edge 602 of the panel 601 under/into each post covering 503. The cap 603 is also preferably cut and sized to fit between the post coverings 503 and preferably has an interior cavity 604 appropriately sized/shaped to fit over and receive the top fence bar 201. The cap 603 may be secured if desired to the fence bar 201 and/or to either or both of the fence covering posts 503 via any conventional means e.g., suction, snaps, clips, bolts, screws, etc.

Figure 6B:
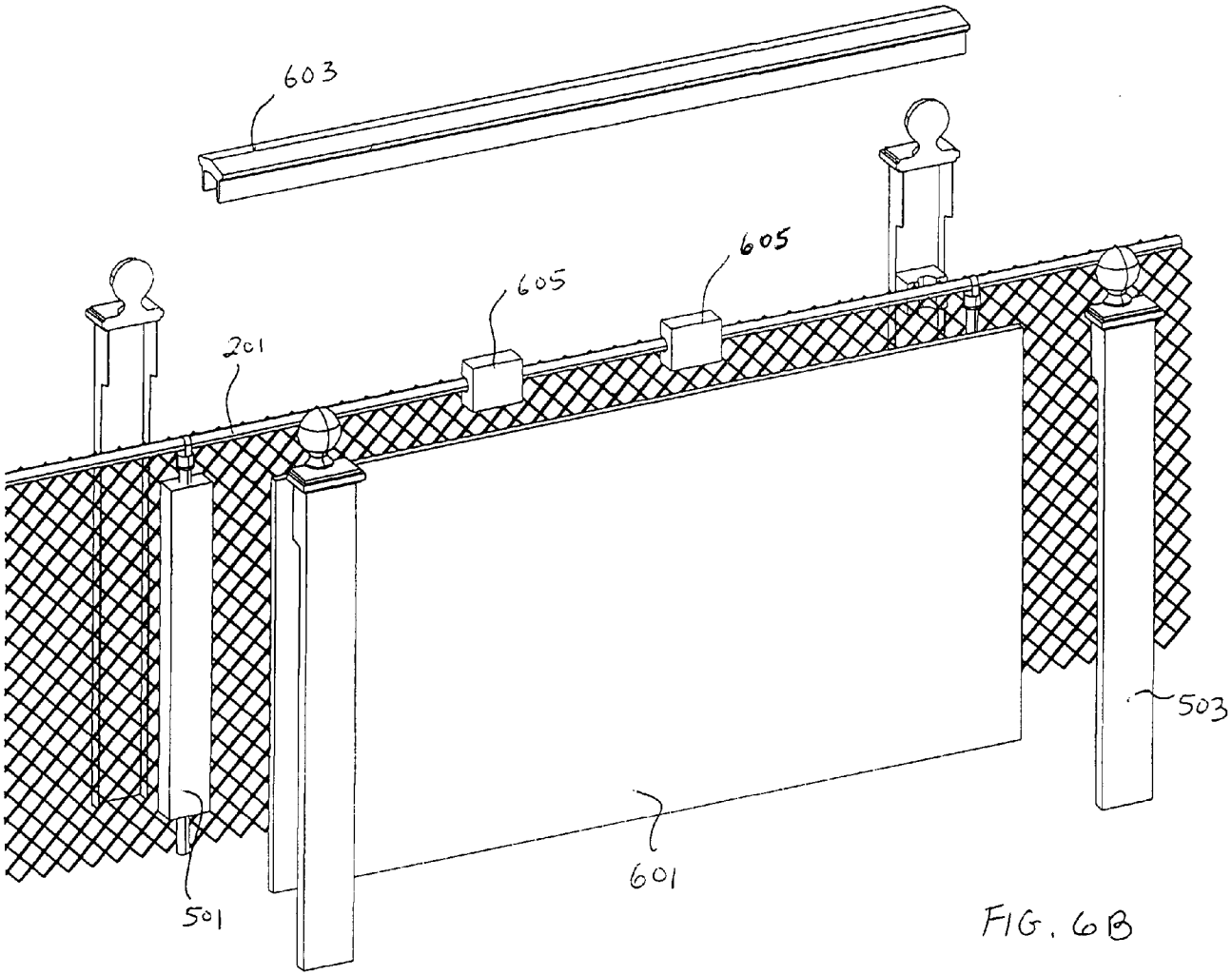

Alternatively, the cap 603 may be attached to the fence bar 201 via mounting onto at least one cap mount 605 (see FIG. 6B). Preferably, for optimal stability, at least two cap mounts 605 are used for mounting the cap 603 thereon. Each cap mount 605 may be attached to the fence bar 201 by any conventional means, e.g., screws, bolts, snaps, suction, etc.

Figure 6C:
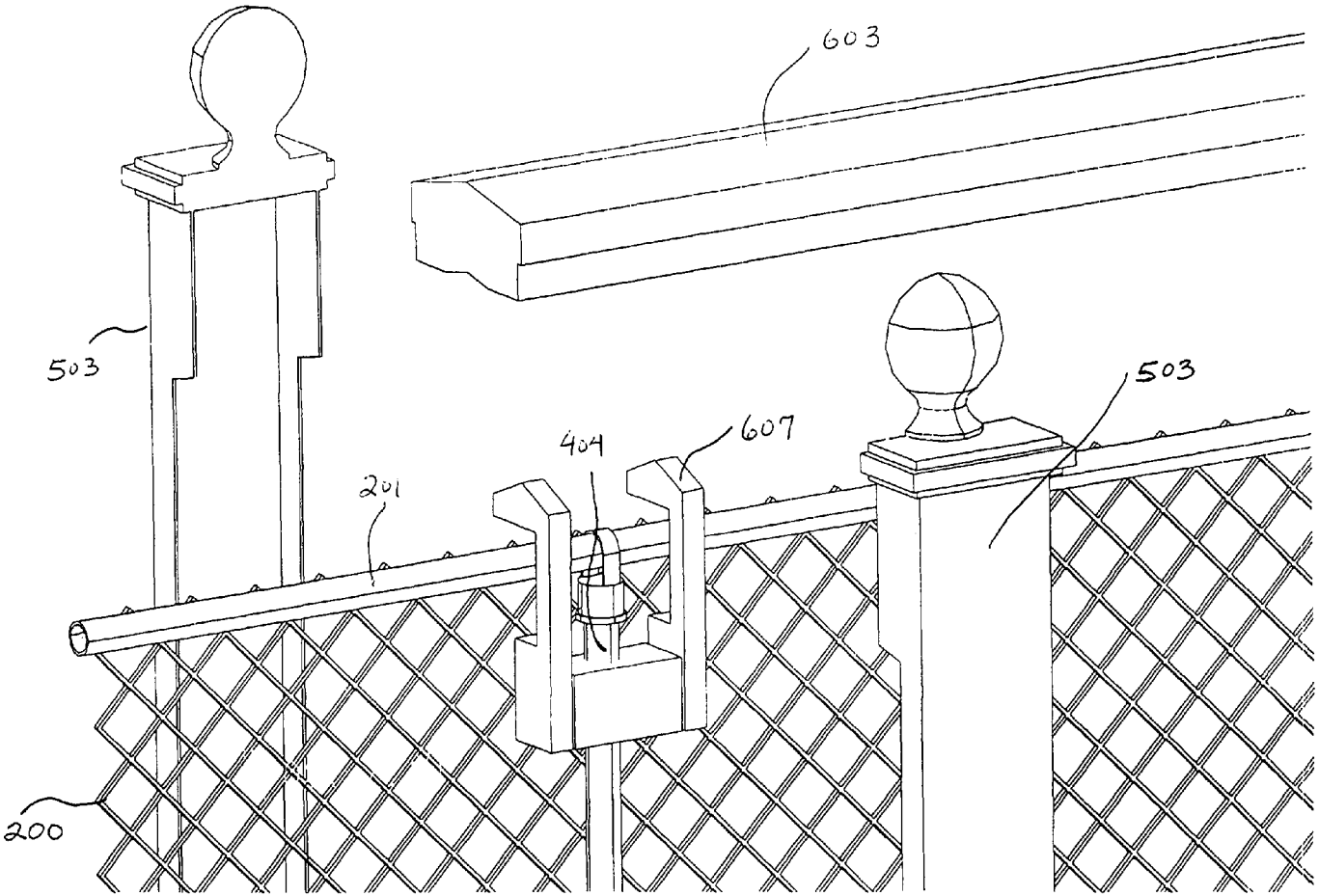

In another embodiment as shown in FIG. 6C, a modified post mount 607 may be provided for attachment to a top end of the fence post 404. Preferably, each post mount 607 is designed to secure at least one or, alternatively, both post coverings 503 on either side of the fence 200, as well as the cap 603 to the fence 200. The post mount 607 may be affixed to the post 404 via conventional means, e.g., bolts, pressure screws, snaps, etc. It is to be noted that the modified post mount 607 may be used in a similar fashion on a bottom end of the fence bar 404.

Figure 6D:
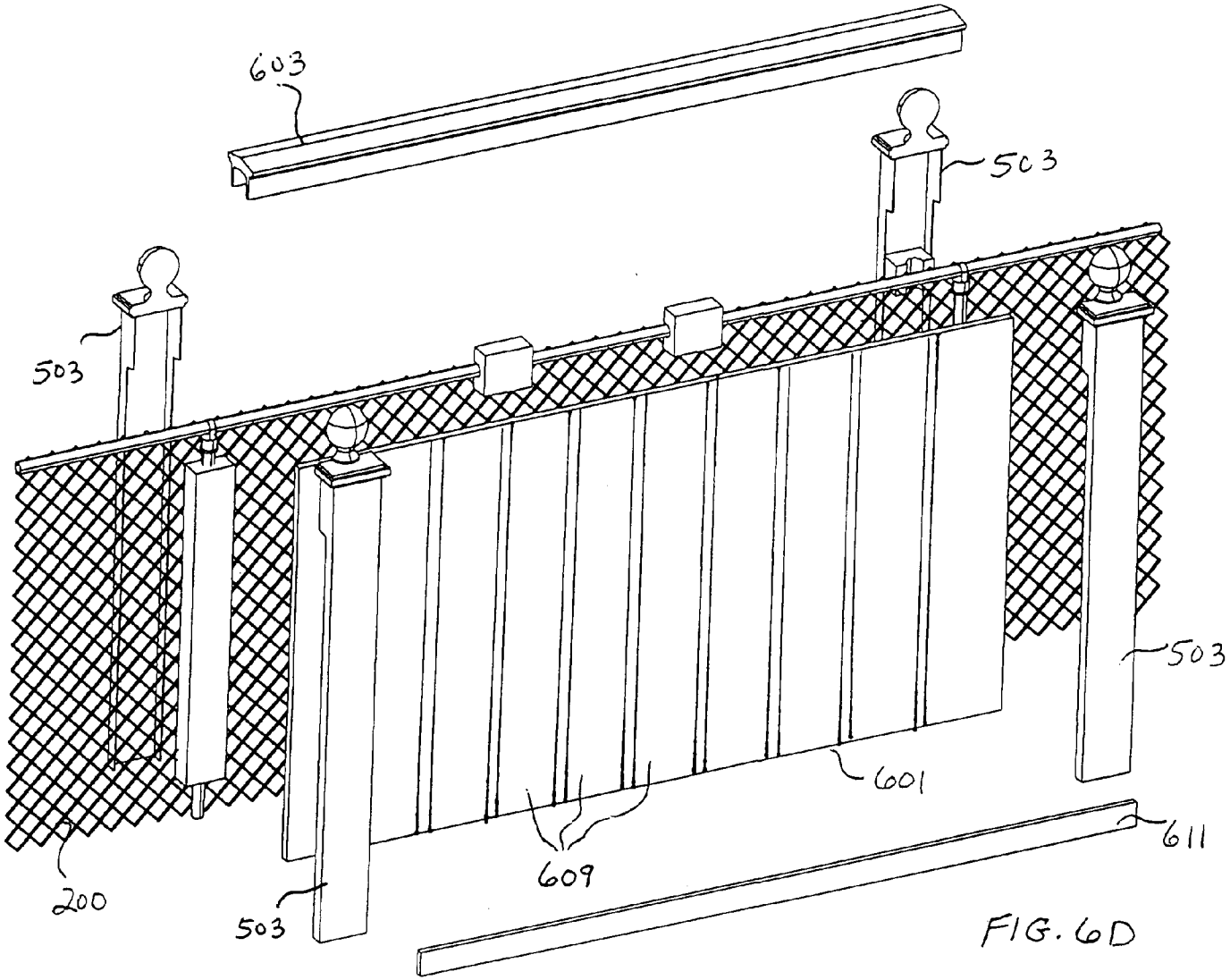

It is to be noted that the side panel 601 may be comprised of individual panels 609 that are integrated (e.g., attached) to each other (see FIG. 6D). The individual panels 609 may be pre-cut in various sizes/shapes and may each have identical or varying widths and dimensions. The individual panels 609 are preferably designed to fit together and include means for attaching to each other. For example, each panel 609 may be secured to each other by various conventional means, e.g., via snaps, by being slid into place and secured via interlocking mechanisms, etc. The individual panels 609 are removable/attachable to each other as desired to adjust the width of the overall side panel 601. A lower bar panel 611 may also be added, for example, along the lower portion of the fence between each post covering 503. The lower bar panel 611 may be secured to the fence 200 via snaps, screws, bolts, etc.

Figure 6E:
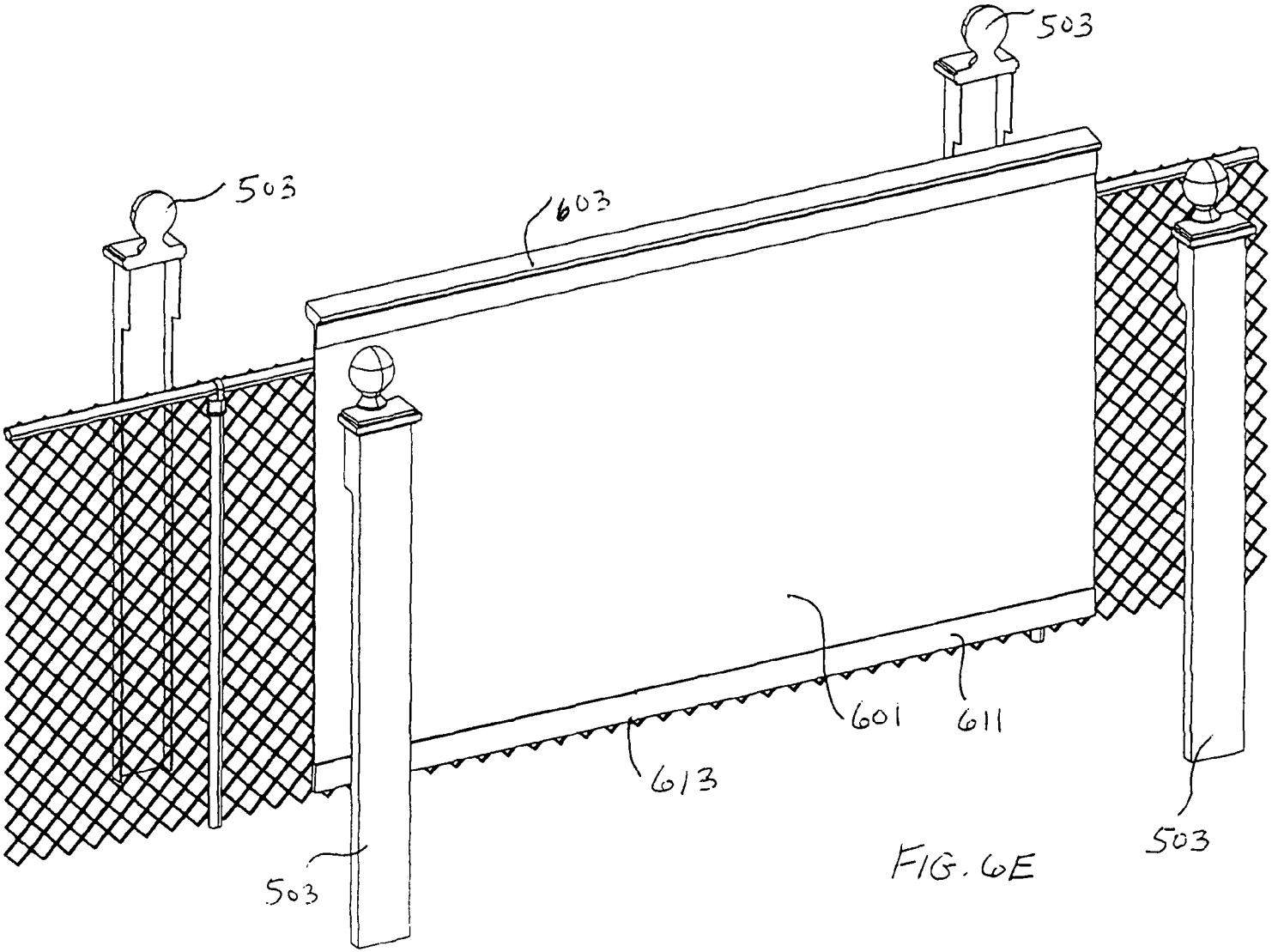
Figure 6F:
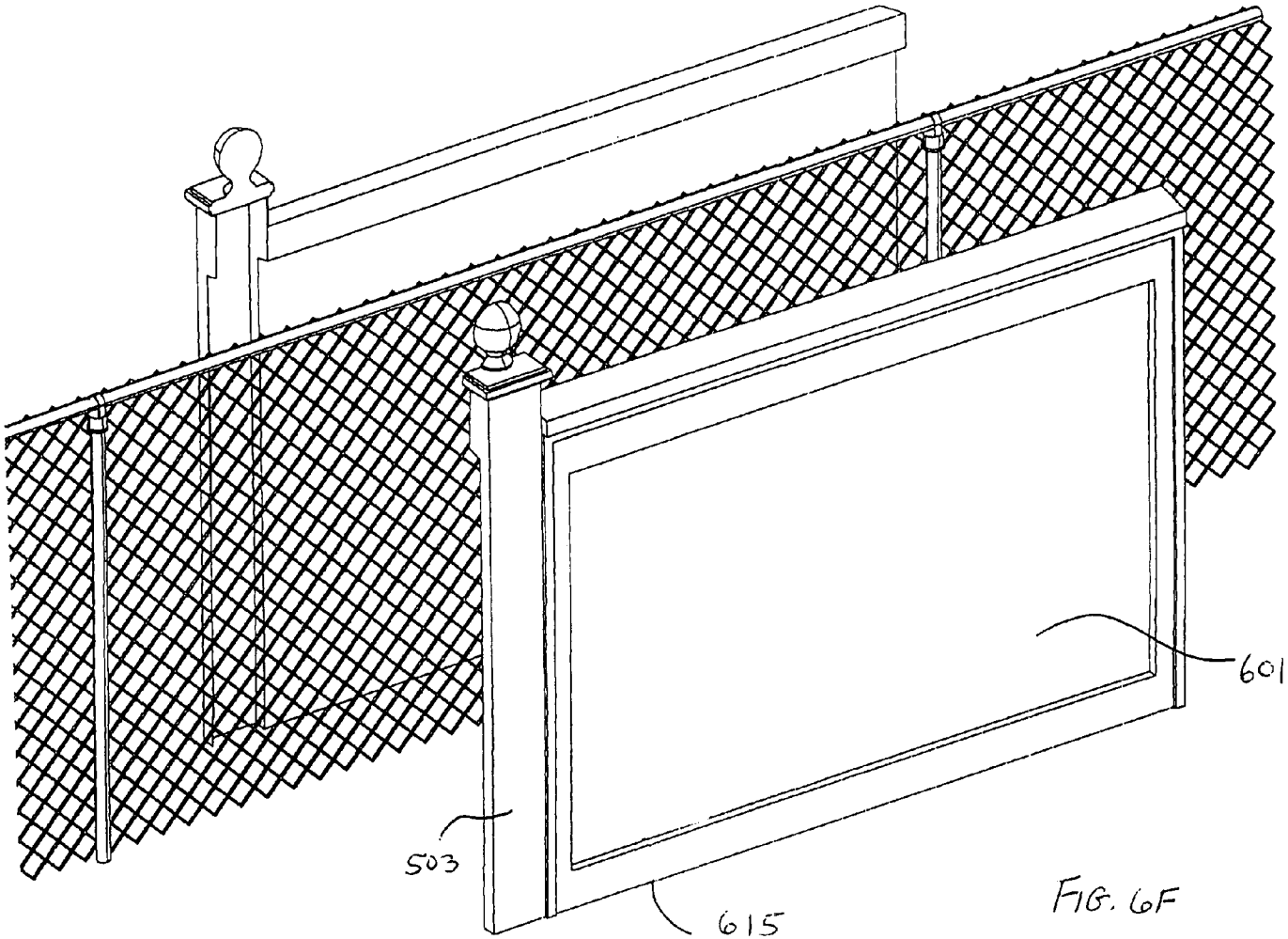
Figure 6G:
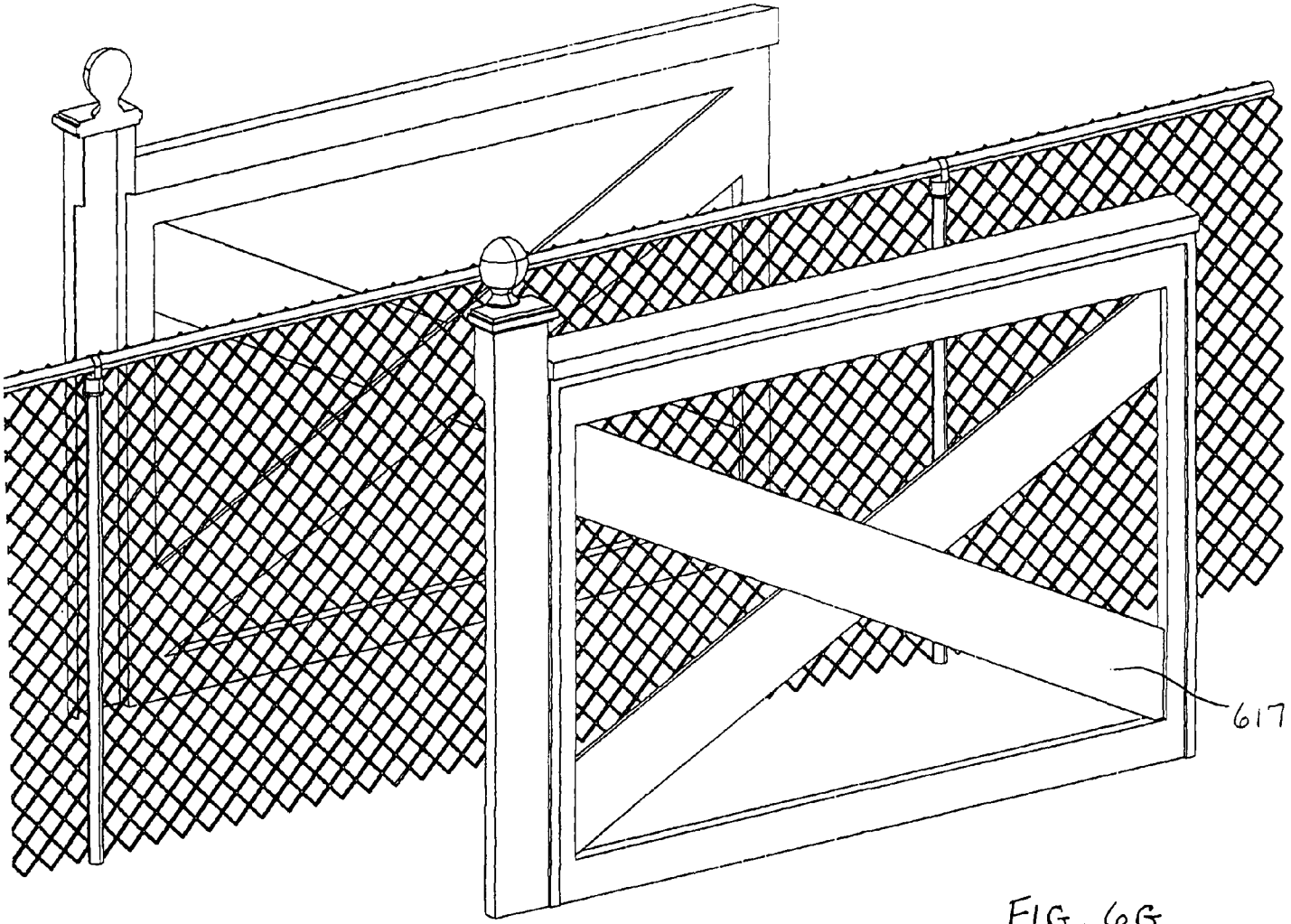

In another embodiment, the side panel 601 having the cap 603 and the lower bar panel 611 attached thereon may be provided as a single side panel unit 613 for ease of installation (see FIG. 6E). The single side panel unit 613 may be mounted onto one or both sides of the fence 200. In yet another embodiment, the single side panel unit 613 may be further combined with at least one post covering 503 to provide a combined panel and post unit 615 (see FIG. 6F). The combined panel post unit 615 may include one or two post coverings 503. It is to be noted that the side panel 601, whether or not it is combined with the cap 603, the lower bar panel 611 or the post covering 503, may be constructed in various designs (e.g., cross-panels 617 (see FIG. 6G), picket design, etc.) and/or further customized to include various graphics (e.g., as described above for the interior panel 104).

Figure 6H:
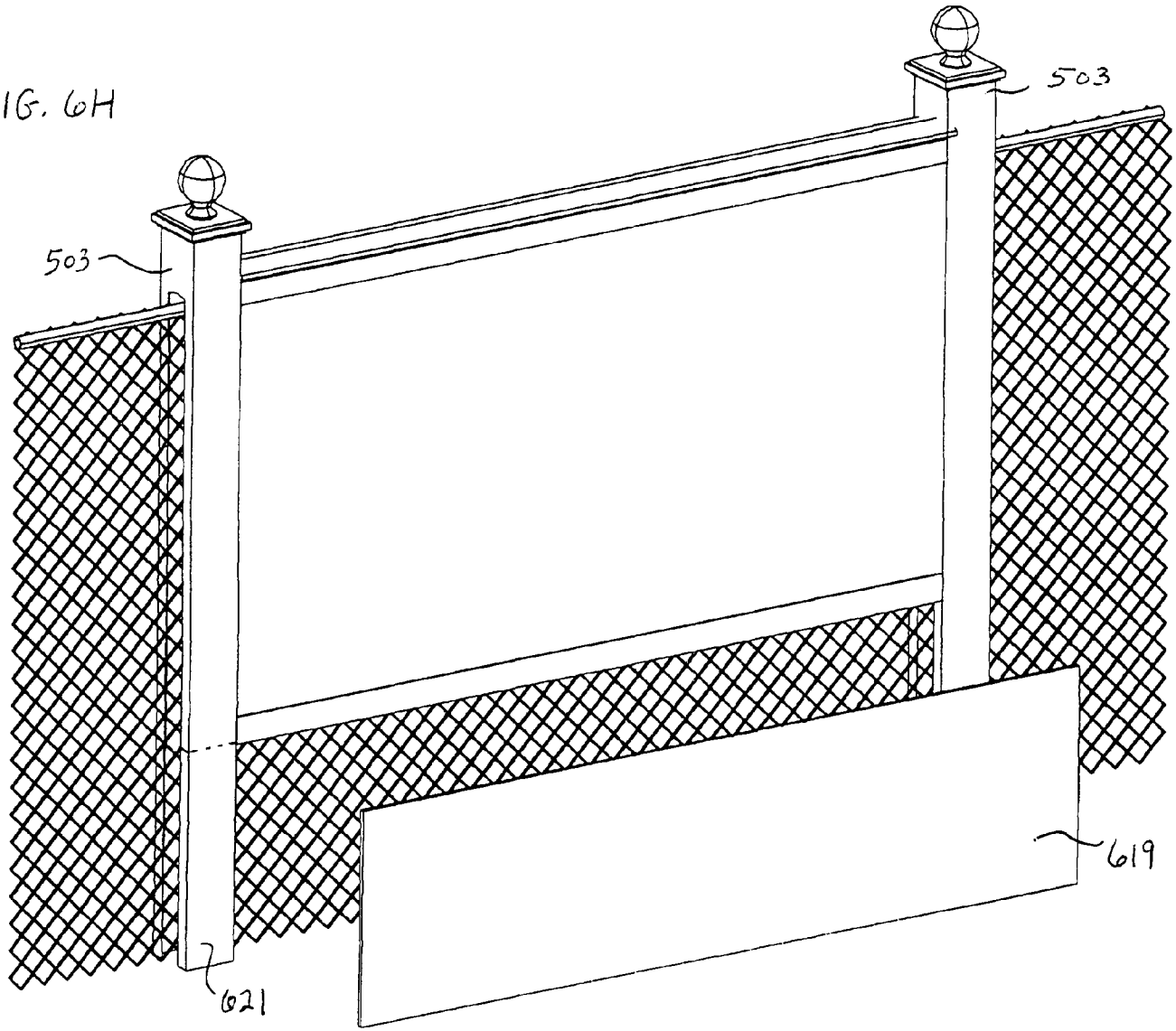
Figure 61:
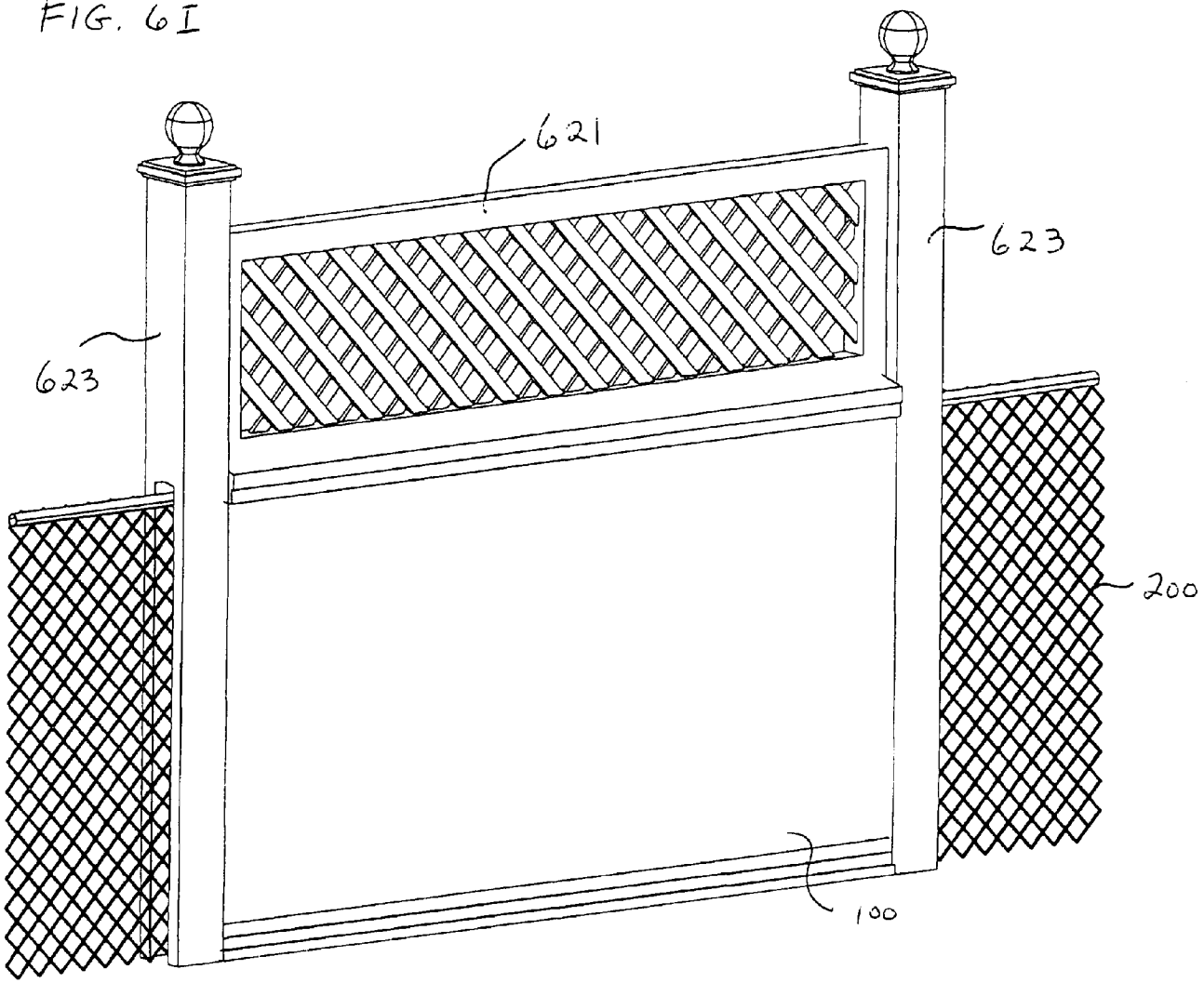
Figure 63:
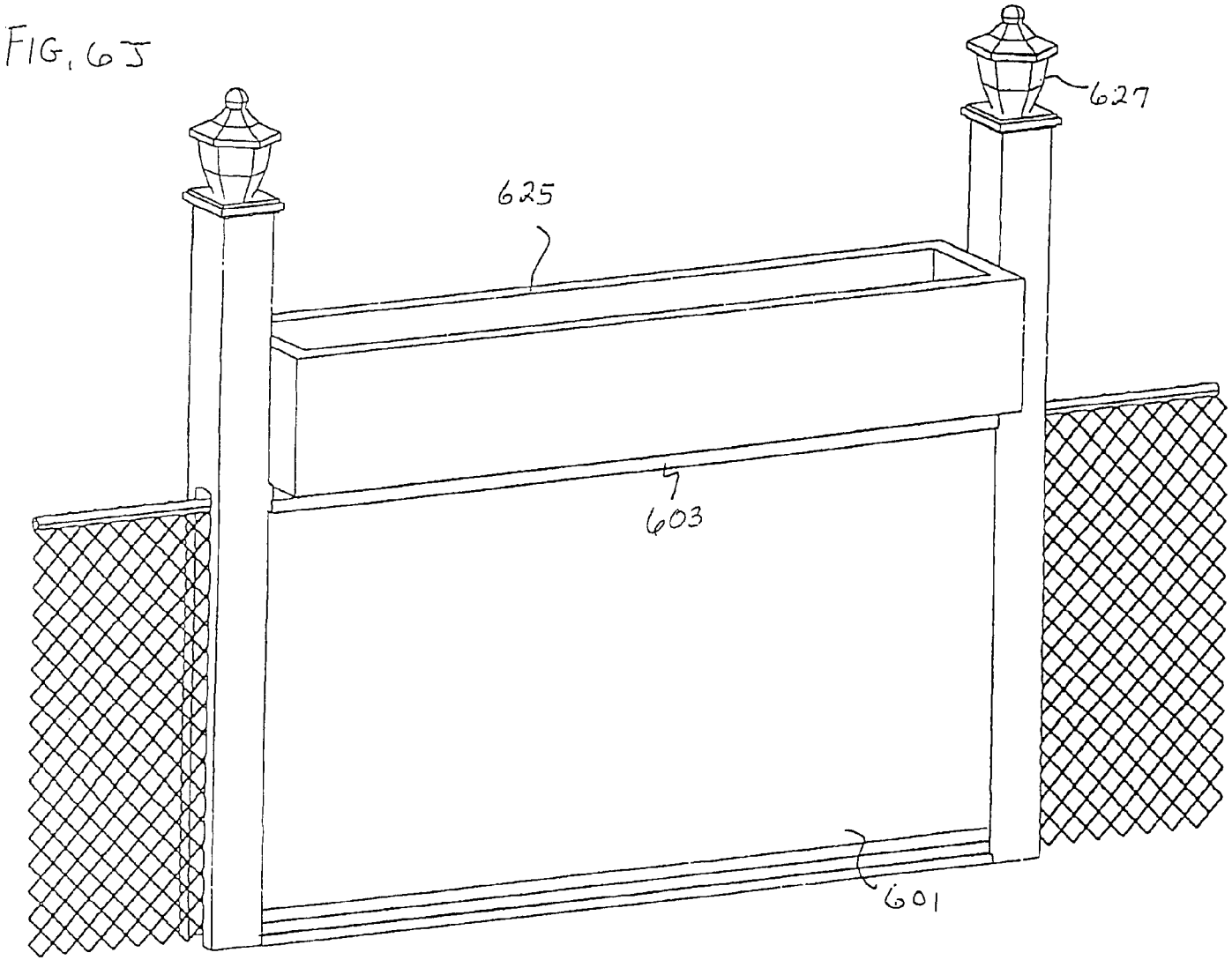

In an alternate embodiment, the combined panel and post unit 615 may be modified, e.g., to have a removable lower section 619 as well as a removable lower post covering 621 (see e.g., FIG. 6H). It is to be noted that either the lower section 619 and/or the lower post covering 621 may be removed or added as desired. Preferably, the post covering 503 is attached at at least one point on the upper portion of the fence post 404 (see e.g., FIG. 6C) via, e.g., post mount 501, mounting pieces 505 or modified post mount 607 as described above, such that even if the lower post covering 621 is removed, the remaining portion of the post covering 503 is supported by and affixed to the fence post 404 (not shown).

In another embodiment as shown in FIG. 6I, extended post coverings 623 may be provided which extend upwards a desired height beyond the height of the fence 200. An upper panel 621 may be added which fits between the extended post coverings 623 to extend the height of the fence 200 as desired. The upper panel 621 may be removably attached to the top of the cap 603 or to the top of the fence covering panel 100, or be combined with the fence covering panel 100 as one unit. In addition, the extended post coverings 623 may optionally include attachment points (not shown) for securing each end of the upper panel 621 to the extended post coverings 623.

In another embodiment as shown in FIG. 6J, a removable planter box 625 may be mounted between the extended posts 623. The planter box 625 may be permanently affixed or integrally formed with the side panel 601. It is to be noted that the planter box 625 may be affixed, for example, atop the cap 603 or directly atop the side panel 601, and may further be secured to the extended posts 623 at each end. The extended posts 623 may further optionally include lamps 627 or other ornamental features attached, for example, at a top end.

Figure 6K:
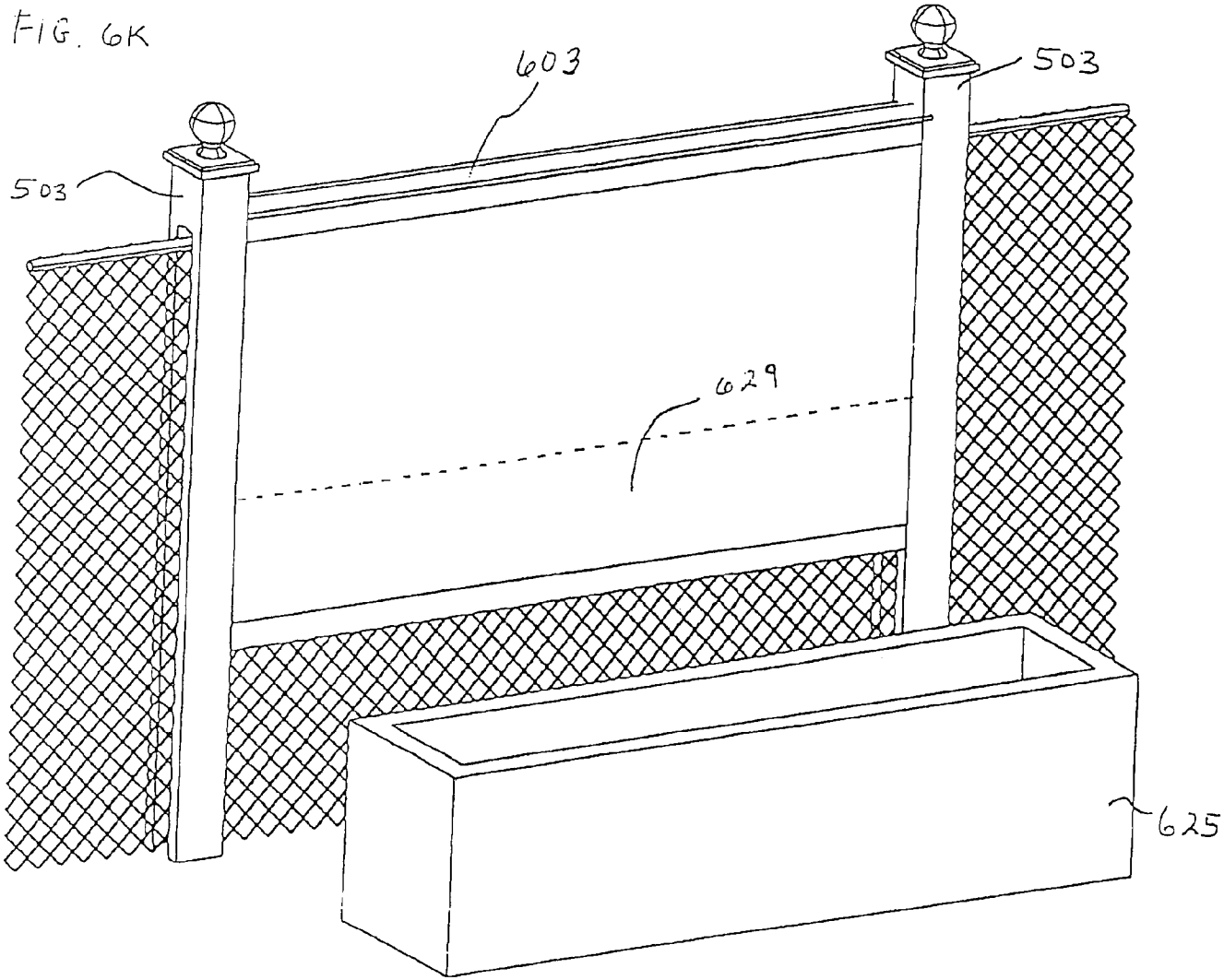

Alternatively, the planter box 625 may be permanently/removably attached to the bottom end of the fence 200 between each post covering 503 (see e.g., FIG. 6K). In this embodiment, the side panel 601 may include, for example, a removable panel 629 for providing pass-through of light through the fence 200 when the planter box 625 is used. It is to be noted that the side panel 601 may be comprised of openings, perforations, etc., in any configuration to also permit pass-through of light as desired.

Figure 6L:
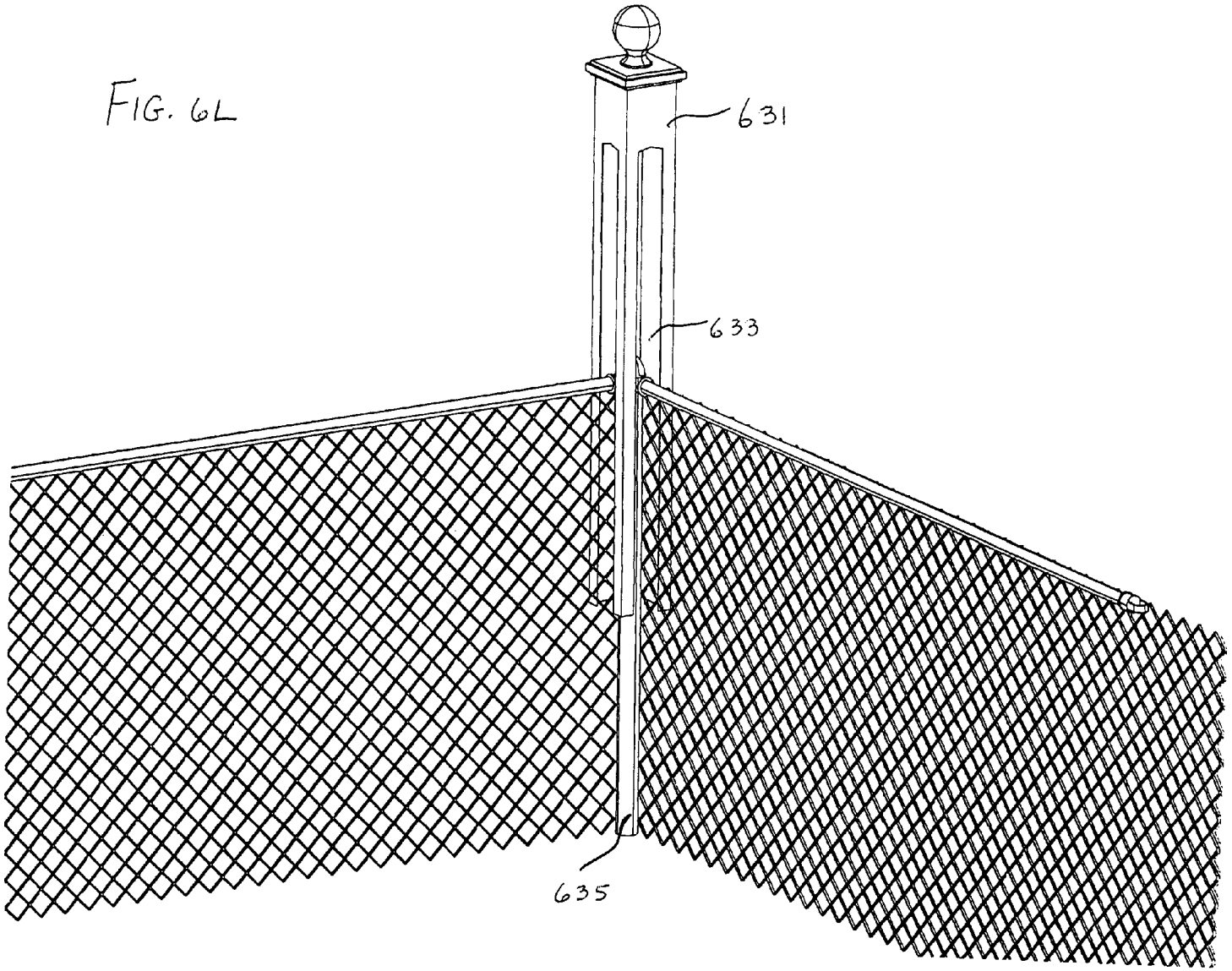

A corner post covering 631 may be provided having slots 633 enabling the covering 631 to be slid into place over a fence corner post 635 (see FIG. 6L). Alternatively, an extended version of the corner post covering 631 may be provided and the slots 633 may serve as receiving points on at least two adjacent sides of the corner post covering 631 for permitting attachment of, for example, the upper panels 621 (see FIG. 6I). The slots 633 may comprise, e.g., openings sufficient for insertion of one end of the upper panel 621 and may include locking mechanisms to secure the upper panels 621 therein. Any other conventional means (e.g., snaps, bolts, etc.) for attachment of the upper panel 621 to the extended version of the corner post covering 631 may be contemplated.

Figure 7A:
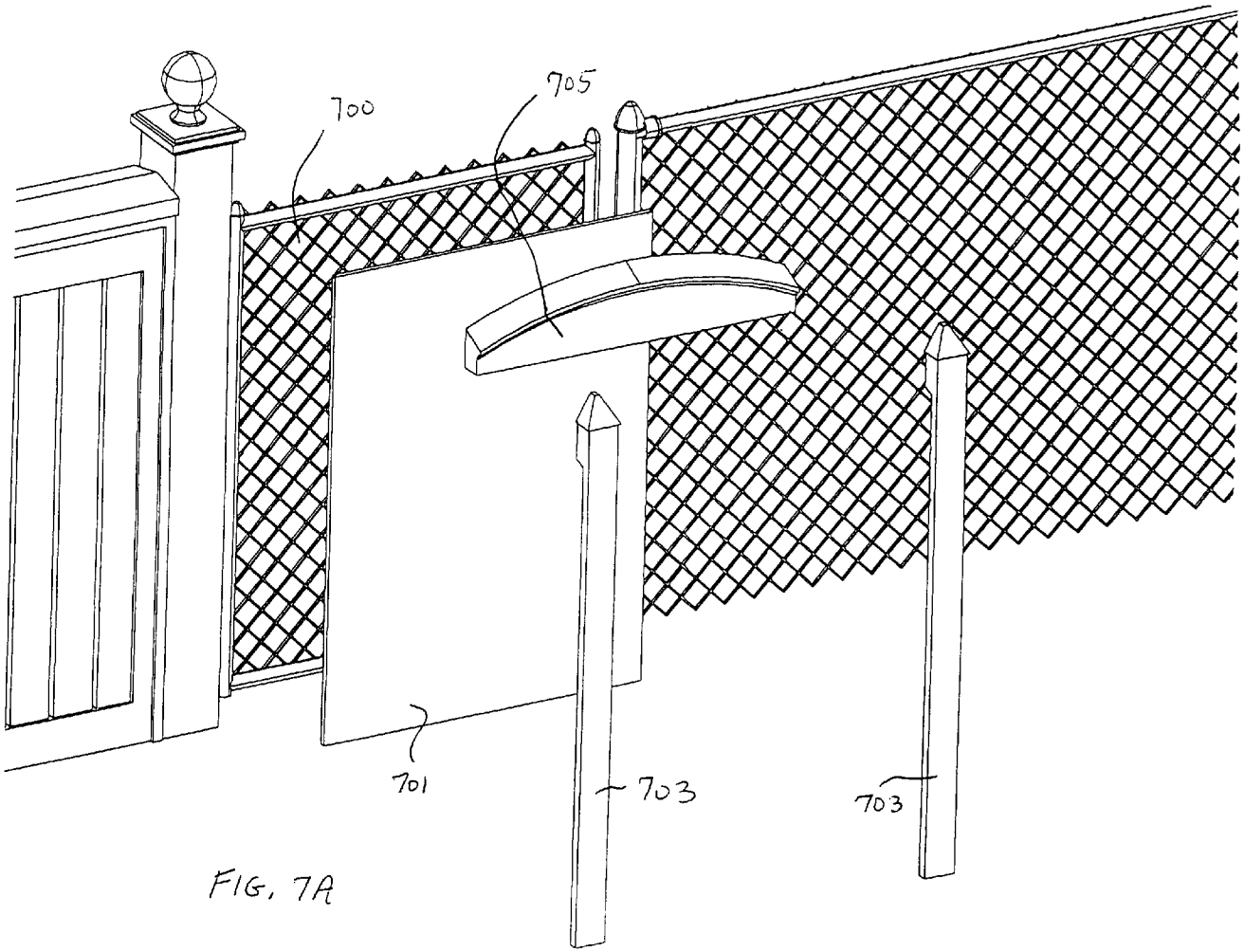
FIGS. 7A-7C are perspective views showing hardware employed on gates in accordance with embodiments of the present invention.
Figure 7B:
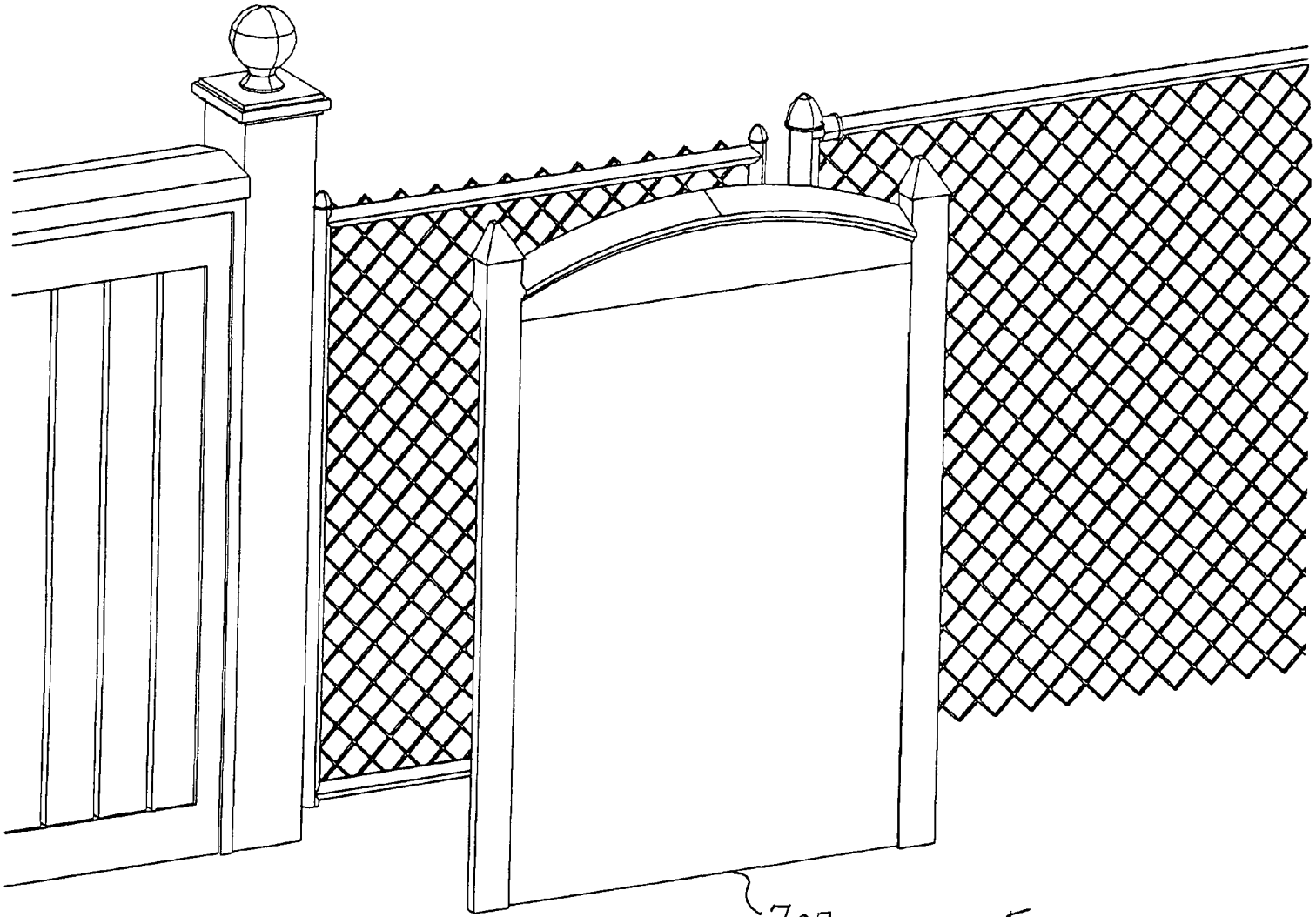
Figure 7C:
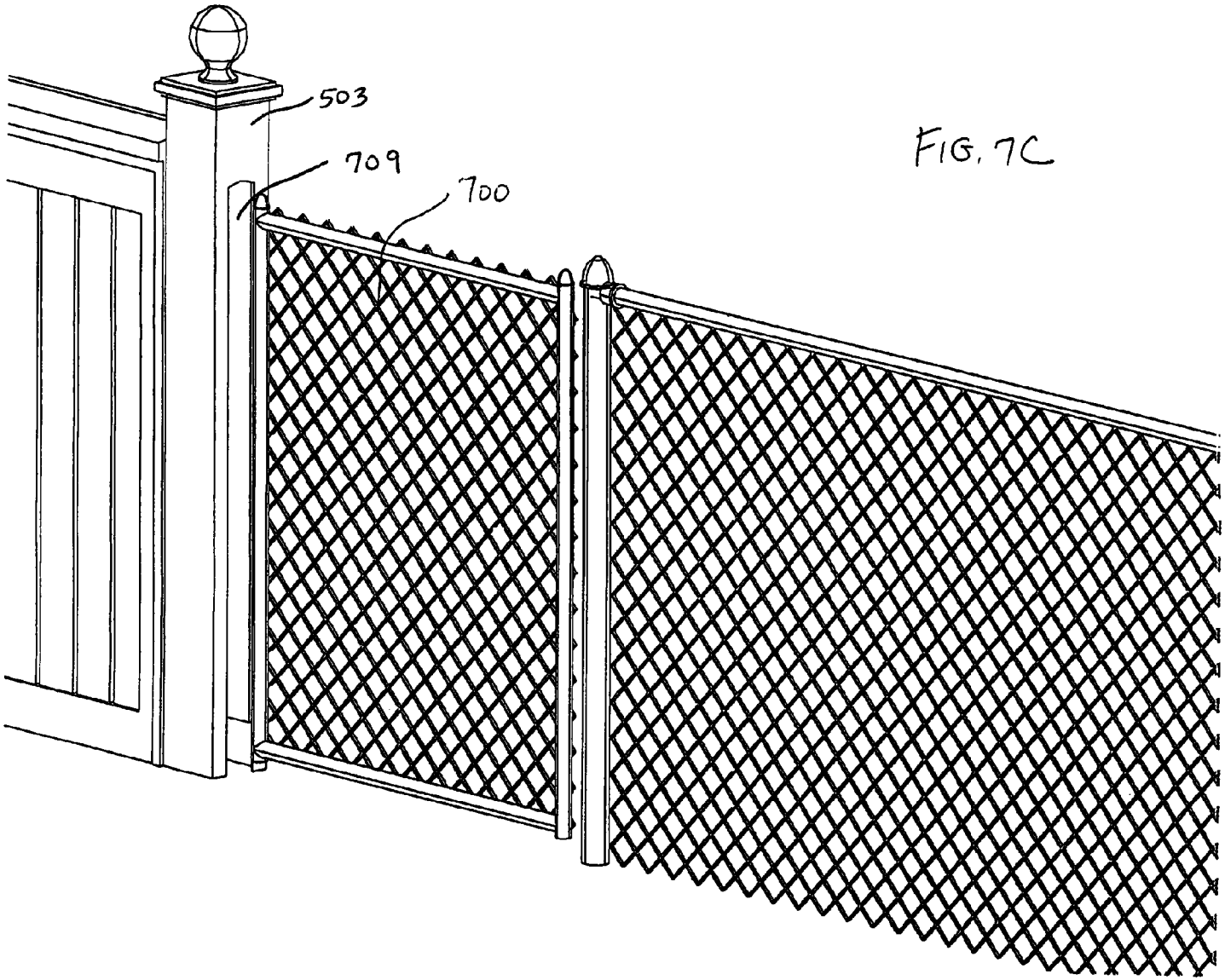

FIGS. 7A-7C depict various embodiments of the present invention as adapted for fence gates. At a basic level, a gate side panel 701, gate post coverings 703 and a gate cap 705 may be provided for covering a fence gate 700. Alternatively, 701, 703 and 705 may be provided as a combined single fence covering unit 707 (see FIG. 7B). It is to be noted that the fence post covering 503 which covers a fence post adjacent to the opening point of the fence gate 700 may be modified to include, e.g., a slot 709 or other means for receiving a gate locking hinge or other locking/closing mechanism on the fence gate 700.

Having described preferred embodiments for fence covering systems (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A fence covering system, comprising:

a first frame configured and dimensioned for covering a portion of an existing fence, and a second frame connected to the first frame at an upper portion, wherein the first or second frame is adapted to receive a fence pole;

the first frame and the second frame each including, and configured to accept, a first panel and second panel, respectively, the first panel and the second panel forming a major surface thereof for covering an existing fence, the first frame and the second frame supporting edges of the respective panels such that the frames enclose at least a top edge of the respective panels, without the first and second panels overlapping, the first and second panels each providing a visual effect; and securing means mechanically securable to the existing fence, the securing means for providing an anchor position on the fence to permit a portion of at least one of the first frame and the second frame to be attached to the connector to secure the frame to the fence.

2. The fence covering system as recited in claim 1, wherein the securing means includes a connector having a first portion for a first side of a fence and a second portion for a second side of the fence opposite the first side, wherein a portion of the connector passes through the fence for attaching the first and second portion.

3. The fence covering system as recited in claim 2, wherein the connector includes split half portions adapted to connect over a fence pole.

4. The fence covering system as recited in claim 2, wherein the connector includes an adjustable portion, which extends longitudinally along the existing fence to provide a connection position for a plurality of frames.

5. The fence covering system as recited in claim 1, further comprising a plurality of frames disposed adjacent to one another along the fence wherein each frame is connectable to the adjacent frame or frames.

6. The fence covering system as recited in claim 1, wherein the first and second frames include a top portion, which is adapted to extend a height above the existing fence.

7. The fence covering system as recited in claim 1, wherein the frame includes a portion, which receives a planter.

8. A fence covering system, comprising:

a frame configured and dimensioned for covering a portion of an existing fence, wherein the frame is adapted to receive a fence pole, and adapted to receive a panel;

the panel having edges supported by the frame such that the frame encloses at least a top edge of the panel, the panel providing a visual effect; and a mounting plate attachable on the frame or on a portion of the fence, the mounting plate providing an attachment point for the frame, the mounting plate including an adjustable portion, which extends longitudinally along the existing fence to provide a connection position for a plurality of frames.

* * * * *